US012281886B2

(12) United States Patent
Vabnick

(10) Patent No.: US 12,281,886 B2
(45) Date of Patent: Apr. 22, 2025

(54) METHODS FOR RENDERING SAFE DEVICES CONTAINING EXPLOSIVES

(71) Applicant: Federal Bureau of Investigation, Washington, DC (US)

(72) Inventor: Ian B. Vabnick, Fredericksburg, VA (US)

(73) Assignee: Federal Bureau of Investigation, Washington, DC (US)

( * ) Notice: Subject to any disclaimer, the term of this patent is extended or adjusted under 35 U.S.C. 154(b) by 0 days.

(21) Appl. No.: 18/093,277

(22) Filed: Jan. 4, 2023

(65) Prior Publication Data

US 2023/0213321 A1 Jul. 6, 2023

Related U.S. Application Data

(60) Provisional application No. 63/296,716, filed on Jan. 5, 2022, provisional application No. 63/309,659, filed on Feb. 14, 2022.

(51) Int. Cl.
*F42B 33/06* (2006.01)

(52) U.S. Cl.
CPC ..... *F42B 33/06* (2013.01)

(58) Field of Classification Search
CPC ..... F42B 33/00; F42B 33/06
See application file for complete search history.

(56) References Cited

U.S. PATENT DOCUMENTS 1,506,354 A * 8/1924 Gustave ..... F42B 33/06 86/49
2,824,482 A * 2/1958 North ..... F42B 33/06 86/49
3,495,527 A * 2/1970 Lafreniere ..... B30B 1/32 72/446

(Continued)

FOREIGN PATENT DOCUMENTS

CN 113175850 B * 10/2023 ..... F42B 33/06
DE 4337003 C1 * 12/1994 ..... F42B 33/06

OTHER PUBLICATIONS

Hydraulic Presses, Dake Corp., Web page https://www.dakecorp.com/products/hydraulic-presses, Nov. 16, 2018, retrieved from Internet Archive Wayback Machine http://web.archive.org/web/20181116201257/https://www.dakecorp.com/products/hydraulic-presses on Sep. 12, 2023.

(Continued)

*Primary Examiner* — Derrick R Morgan
(74) *Attorney, Agent, or Firm* — Jonathan W. Parthum; Andrew C. Stark

(57) ABSTRACT

Disclosed is a method for rendering safe an Improvised Explosive Device (IED) via a powered mechanical press. The method includes identifying and classifying the IED and placing the IED into the press and determining a position of the IED within the press based on the classification of the IED. The method further includes activating the press until a fracturing device of the press reaches a fracture position with respect to the IED and holding the position of the press (Continued)

for a predetermined period of time when the fracturing device reaches the fracture position. Further, the method includes removing, after the IED has fractured, the fractured IED and explosive filler of the fractured IED.

22 Claims, 12 Drawing Sheets

(56) References Cited

U.S. PATENT DOCUMENTS

| | | | | | |
|---|---|---|---|---|---|
| 4,046,055 | A * | 9/1977 | McDanolds | F42B 33/06 | 102/293 |
| 4,283,825 | A * | 8/1981 | McKay | B30B 15/04 | 72/429 |
| 4,431,350 | A * | 2/1984 | Abrahamson | F42B 33/06 | 408/11 |
| 4,473,932 | A * | 10/1984 | Widner | F42B 33/06 | 29/251 |
| 5,301,594 | A * | 4/1994 | Argazzi | F42B 33/06 | 408/56 |
| 5,353,676 | A * | 10/1994 | King | F42B 33/06 | 89/1.13 |
| 5,386,758 | A * | 2/1995 | Conley | F42B 33/06 | 86/50 |
| 5,974,937 | A * | 11/1999 | Doughty | F42B 33/06 | 86/49 |
| 6,212,986 | B1 * | 4/2001 | Decker | F42B 33/06 | 89/1.13 |
| 6,899,007 | B1 * | 5/2005 | Blankenship | F42B 33/06 | 86/50 |
| 6,901,835 | B1 * | 6/2005 | Chamlee | F42B 33/062 | 86/49 |
| 6,978,708 | B1 * | 12/2005 | Blankenship | F42B 33/06 | 86/50 |
| 7,070,365 | B1 * | 7/2006 | Blankenship | B23Q 11/10 | 408/1 R |
| 9,021,931 | B1 * | 5/2015 | Zaun | F42B 33/06 | 86/49 |
| 10,836,069 | B2 * | 11/2020 | Banjo | B27L 7/06 | |
| 2002/0046661 | A1 * | 4/2002 | Hawkins | B30B 1/326 | 100/269.17 |
| 2005/0109199 | A1 * | 5/2005 | Chamlee | F42B 33/062 | 86/49 |
| 2005/0159635 | A1 * | 7/2005 | Osterloh | C06B 21/0091 | 588/403 |
| 2009/0263765 | A1 * | 10/2009 | Jones | F41H 11/12 | 434/11 |
| 2016/0319624 | A1 * | 11/2016 | Kroesen | E21B 33/063 | |
| 2016/0348459 | A1 * | 12/2016 | Jaffrey | E21B 29/08 | |
| 2017/0138713 | A1 * | 5/2017 | Penrod | F41A 23/02 | |
| 2023/0258443 | A1 * | 8/2023 | Vabnick | F42D 5/04 | 86/50 |

OTHER PUBLICATIONS

National Bomb Squad Commanders Advisory Board, Law Enforcement Ground Robots, GRCCE Conference, Apr. 7, 2015 [retrieved on Sep. 12, 2023], pp. 1-41, retrieved from the Internet: https://ndiastorage.blob.core.usgovcloudapi.net/ndia/2015/grcce/Heaven.pdf.

Semi-Autonomous Pipe Bomb End Cap Remover, DHS Science and Technology Directorate, May 16, 2012 [retrieved on Sep. 12, 2023], p. 1, retrieved from the Internet: https://www.dhs.gov/sites/default/files/publications/Semi-Autonomous%20Pipe%20Bomb%20End%20Cap%20Remover-SAPBER_0.pdf.

ANT Applied New Technologies AG, MACE series EOD & IEDD Water Abrasive Suspension Cutting, Nov. 2022 [retrieved on Sep. 12, 2023], pp. 1-20, retrieved from the Internet: https://ant-ag.com/wp-content/uploads/2023/02/MACE-Broschuere-ENG-November-22.pdf.

6 Quart Double Acting Hydraulic Pump, VEVOR, Web page https://www.vevor.com/hydraulic-power-unit-c_10089/6-quart-double-acting-hydraulic-pump-dump-trailer-unloading-lift-crane-p_010984202930, May 22, 2022, retrieved from Internet Archive Wayback Machine http://web.archive.org/web/20220522234207/https://www.vevor.com/hydraulic-power-unit-c_10089/6-quart-double-acting-hydraulic-pump-dump-trailer-unloading-lift-crane-p_010984202930 on Sep. 12, 2023.

Air Hydraulic Pump, VEVOR, Web page https://www.vevor.com/air-hydraulic-pump-c_10085/vevor-air-hydraulic-pump-hydraulic-foot-pump-10-000-psi-with-hose-and-spray-p_010326240346, May 22, 2022, retrieved from Internet Archive Wayback Machine http://web.archive.org/web/20220522035212/https://www.vevor.com/air-hydraulic-pump-c_10085/vevor-air-hydraulic-pump-hydraulic-foot-pump-10-000-psi-with-hose-and-spray-p_010326240346 on Sep. 12, 2023.

https://www.dakecorp.com/products/hydraulic-presses.

* cited by examiner

METHODS FOR RENDERING SAFE DEVICES CONTAINING EXPLOSIVES

CLAIM TO PRIORITY

This application claims priority Provisional Patent Application No. 63/296,716 filed on Jan. 5, 2022, and to Provisional Patent Application No. 63/309,659 filed on Feb. 14, 2022, both of which are hereby incorporated by reference in their entirety.

GOVERNMENT INTEREST STATEMENT

The United States Government has rights in this invention pursuant to the relationship of the Government to at least one inventor.

BACKGROUND

Improvised Explosive Devices (IEDs) can be found throughout the world. Pipe bombs are the most prevalent IEDs encountered within the United States, as they are easy to build and contain materials that are easy to obtain. They can be constructed from many types and combinations of materials such as steel/iron, polyvinyl chloride (PVC), copper and cardboard tubing, and are often filled with low explosive filler such as black powder, smokeless powder, or flash powder. Outside the United States, military ordnance has been converted into IEDs or discovered in an uncontrolled state and thus assumed to be altered or damaged and still hazardous.

Due to the structural nature of enclosed IEDs, such as pipe bombs, they often require significant force to render safe by sufficiently compromising their structural integrity such that all of the explosive filler therein can be readily and completely removed or the fuze(s) rendered inoperable or separated. Public Safety Bomb Squads (PSBS) employ a variety of tools and techniques to deal with IEDs. One technique includes using a percussion-actuated non-electric disrupter to fire a specific projectile at an IED. However, this technique carries with it the inherent risk of unintentionally initiating the low explosive filler by the impact from the projectile. Accordingly, a one-size-fits-all approach to disarmament is not applicable to all types of IEDs. Thus, IEDs can have varying methods of disarmament based on the specifics of design and any particular risk(s) inherent to disarming IEDs.

SUMMARY OF THE INVENTION

Disclosed is a method for rendering safe an Improvised Explosive Device (IED) via a powered mechanical press, the method including identifying and classifying the IED; placing the IED into the press and determining a position of the IED within the press based on the classification of the IED; activating the press until a fracturing device of the press reaches a fracture position with respect to the IED; holding the position of the press for a predetermined period of time when the fracturing device reaches the fracture position; and removing, after the IED has fractured, the fractured IED and explosive filler of the fractured IED.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
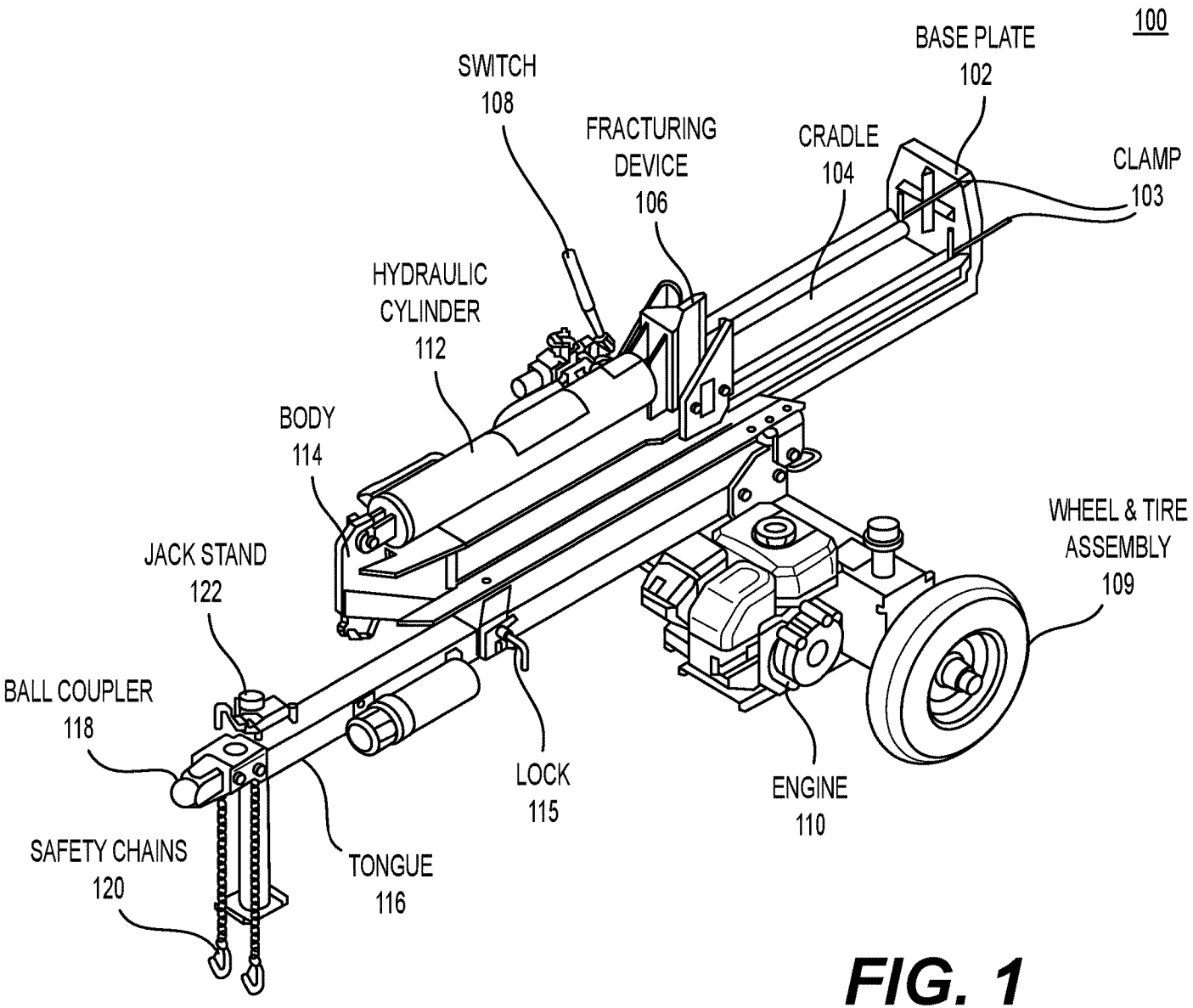
FIG. 1 illustrates an exemplary first hydraulic press.

As used herein "substantially", "relatively", "generally", "about", and "approximately" are relative modifiers intended to indicate permissible variation from the characteristic so modified. They are not intended to be limited to the absolute value or characteristic which it modifies but rather approaching or approximating such a physical or functional characteristic.

In the detailed description, references to "one embodiment", "an embodiment", or "in embodiments" mean that the feature being referred to is included in at least one embodiment of the invention. Moreover, separate references to "one embodiment", "an embodiment", or "in embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

The terminology used herein is for describing particular embodiments only and is not intended to be limiting of the disclosed subject matter. As used herein, the singular forms, "a", "an" and "the" are intended to include the plural forms as well, unless the context clearly indicates otherwise. It will be further understood that the root terms "include" and/or "have", when used in this specification, specify the presence of stated features, integers, steps, operations, elements, and/or components, but do not preclude the presence or addition of at least one other feature, integer, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Additionally, as used herein, any reference to a range of values is intended to encompass every value within that range, including the endpoints of said ranges, unless expressly stated to the contrary.

Referring now to the drawings, wherein like reference numerals designate identical or corresponding parts throughout the several views, the following description relates to a dedicated system and method for finding activities that suits personal preference and schedule of a user and for managing activities that the user signed up for participation.

FIG. 1 illustrates an exemplary first hydraulic press 100. The first hydraulic press 100 has a base plate 102 and a cradle 104 configured to receive an IED. The IED can be any type of hazardous device including, but not limited to, military ordnance (i.e., mortar shell, bomblet, submunition, rocket, or military grenade), uncontrolled ordnance, elbow pipe fittings, pipe nipples, civilian improvised grenades, copper or carboard cased, and PVC pipes, each containing at least one explosive such as FFFg black powder, flash powder, or smokeless powder (See, e.g., FIGS. 6-12). The base plate 102 is configured to receive an optional platform (See, e.g., FIGS. 4A-4K, FIGS. 6-8) for positioning an IED thereon. In these exemplary embodiments, the IED is positioned within the cradle 104 at in a particular position on the base plate 102 (or optional platform) such that the IED is in line with a fracturing device 106. Accordingly, the cradle 104 is of a size sufficient to receive a variety of different IEDs as would be understood by one of ordinary skill in the art. In one exemplary implementation, the width of the cradle 104 is one foot and the length between the fracturing device 106 and the base plate 102 is two feet. These dimensions are exemplary only, as other widths and/or lengths can be used without departing from the scope of the present subject matter.

In one implementation, a clamp 103 is configured to secure the IED within the cradle 104. Although various types of clamps or fasteners known to those of skill in the art may be used without departing from the scope of the present subject matter, in this example clamp 103 is comprised of an L-shaped rod which protrudes through base plate 102 (and optional platform if used, See FIGS. 4A-4K) and extends linearly along a length of cradle 104 such that it can be raised and lowered based on the size of an IED. Clamp 103 can be rotated axially about its center point such that the L portion of clamp 103 can be moved to cover the IED. Once the L portion of clamp 103 is in position to secure the IED, clamp 103 is fastened to the IED via a fastening device secured to the underside of base plate 102, such as, for example, by a nut on a threaded portion of clamp 103.

As discussed further herein, when rendering safe an IED the IED is positioned such that fracturing device 106 is in line with a particular section of the IED. In some implementations, the IED is positioned horizontally across a length of base plate 102 such that it lies perpendicular to fracturing device 106. Once the IED is positioned and secured on base plate 102 (or platform) within cradle 104, a switch 108, such as a lever, operatively connected to an engine 110, is moved to an activation position which results in engine 110 activating a hydraulic cylinder 112, operatively connected thereto, to displace via hydraulic pressure fracturing device 106 linearly along the length of cradle 104 in an axial direction along base plate 102. Switch 108 can have different settings such that the degree of movement of the switch increases or decreases the amount of hydraulic pressure applied to fracturing device 106. Releasing switch 108 causes it to return to its starting position (automatically in certain exemplary embodiments), which signals to engine 110 to control hydraulic cylinder 112 to stop applying hydraulic pressure to fracturing device 106, thereby stopping any lateral movement of fracturing device 106. In certain exemplary embodiments, switch 108 can optionally be moved into a retraction position (not shown) which causes fracturing device 106 to move laterally along cradle 104 in an axial direction toward hydraulic cylinder 112 and away from base plate 102. In one example, switch 108 is pressure-activated (as understood by one of ordinary skill in the art) such that varying degrees of pressure applied to switch 108 result in a varying rate of movement of fracturing device 106. In certain exemplary embodiments, switch 108 is remotely operated either via a hardwire connection or wirelessly as would be understood by one of ordinary skill in the art, thereby allowing for a varying rate control of hydraulic press 100 from a distance. In another exemplary embodiment, switch 108 activates a fracturing device control unit which can be programmed to execute a sequence of stroke steps, apply a constant force, ramp the force at a specified rate, check for contact with an IED as described herein, deactivate to maintain force, and/or or set a duration time for each stroke position in the lateral direction thereby in one implementation automatically performing the steps 508-520 of FIG. 5.

In certain exemplary embodiments, hydraulic pressure device 100 further includes body 114 holding at least one of hydraulic cylinder 112, switch 108, cradle 104, and base plate 102. In the exemplary embodiment shown body 114 is affixed to a tongue 116, which supports engine 110. Body 114 further includes a wheel and tire assembly 109 configured to transport hydraulic press 100 to wherever threats are detected. To facilitate such movement, hydraulic press 100 optionally includes a ball coupler 118 and safety chains 120 configured to secure hydraulic press 100 to a vehicle for expedient transport. Upon arrival at a threat site, hydraulic press 100 is quickly detachable from a vehicle and moveable to a threat location, and in certain exemplary embodiments is configured to receive a jack stand 122 to secure hydraulic press 100 at a threat location. For illustration purposes and ease of discussion, hydraulic press 100 is illustrated in a horizontal mobile layout, but in certain exemplary embodiments is adjustable via lock 115 interconnecting the body 114 and tongue 116 to move body 114 to a vertical position such that base plate 102 is positioned on or just above the ground such that activation of switch 108 causes lateral displacement of fracturing device 106 in an axial direction to or away from the ground. In the exemplary embodiments shown, once in position, hydraulic press 100 moves fracturing device 106 into contact with an IED positioned on base plate 102 such that the IED will fracture and dispel its explosive filler, thereby rendering the IED safe for disposal.

Figure 2:
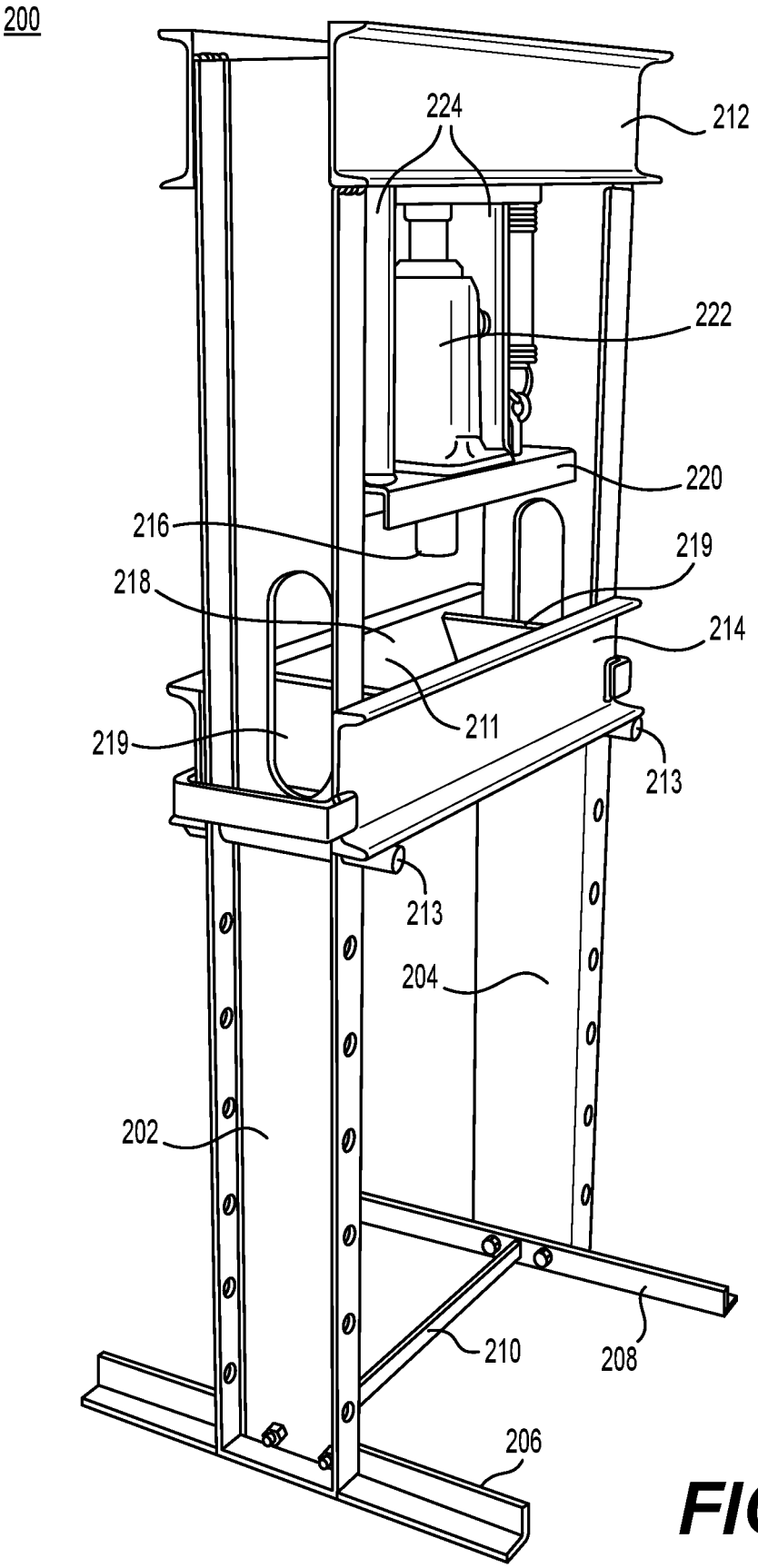
FIG. 2 illustrates an exemplary second hydraulic press.

FIG. 2 illustrates an exemplary second hydraulic press 200. Second hydraulic press 200 includes legs 202,204 mounted on feet 206,208 connected at the bottom by a cross brace 210. At the top of legs 202,204, a head piece 212 connects to legs 202,204 and provides resistance for second hydraulic press 200. A bottle jack, or hydraulic powered ram, 222 cylinder pushes against head piece 212, which creates a reaction force downward as the cylinder extends from the hydraulic powered ram 222. A bed 214 extends transversely across legs 202,204 and is positioned about midway between head piece 212 and feet 206,208 and is carried by pins 213 that engage bed 214 and legs 202,204 at opposite ends of the bed 214. In certain exemplary embodiments, bed 214 is reinforced on opposites end by a diagonally disposed spacer plate 218. A carriage 220 carries a hydraulic powered ram 222 which is guided by one or more pairs of guides 224. In certain exemplary embodiments hydraulic powered ram 222 is powered by an external power source, such as an engine for example (not shown), to power lateral movement of carriage 220 along at least a portion of a length of guides 224. In certain exemplary embodiments, fracturing device 216 is secured on the underside of carriage 220.

In the exemplary embodiment shown, bed 214 is configured to receive any type of IED therein. The bed 214 is also configured to receive an optional platform (See, e.g., FIGS. 4A-4K or FIGS. 6-8). In use, the IED is positioned within bed 214 at a particular position therein (or on optional platforms illustrated in, for example, FIGS. 4A-4K) such that the IED is in line with fracturing device 216. Accordingly, bed 214 is of a size sufficient to receive a variety of different IEDs as would be understood by one of ordinary skill in the art. In one exemplary embodiment, the width and length of bed 214 is two feet and the height is one foot thereby creating a space 211 therein. This width and length are exemplary only, as other bed widths and lengths can be used without departing from the scope of the present subject matter.

In certain exemplary embodiments, spacer clamps 219 optionally secure the IED within bed 214. Although various types of clamps or fasteners may be used, in this example spacer clamps 219 connected perpendicularly to a length of bed 214 are positioned within tracks (not shown) on the base of bed 214, allowing varying degrees of lateral movement of each spacer claim 219 along the length of bed 214. Thus, spacer clamps 219 are laterally moveable inward toward an IED placed within space 211 until they abut and secure the IED within space 211.

As discussed further herein, when rendering safe an IED, the IED is positioned such that fracturing device 216 is in line with a particular section of the IED. In some implementations, the IED is positioned horizontally across a length of bed 214 such that it lies perpendicular to fracturing device 216. Once the IED is positioned and secured in space 211 on bed 214 (or optional platform), a switch (not shown), such as a lever, operatively connected to the engine, is moveable to an activation position which results in the engine activating hydraulic powered ram 222, operatively connected thereto, to displace via hydraulic pressure fracturing device 216 linearly along at least one the of the guides 224 in a direction of bed 214. Releasing the switch will cause it to return to its starting position, which signals to the engine (not shown) to control hydraulic powered ram 222 to stop applying hydraulic pressure to fracturing device 216, thereby stopping any lateral movement of fracturing device 216. In certain exemplary embodiments the switch is moveable into a retraction position which causes fracturing device 216 to move laterally along at least a portion of length of guides 224 in a direction toward the powered ram 222 away from bed 214. In certain examples, the switch is pressure-activated as understood by one of ordinary skill in the art such that varying degrees of pressure applied to the switch result in a varying rate of movement of fracturing device 216. In certain exemplary embodiments the switch is remotely operated either via a hardwire connection or wirelessly as would be understood by one of ordinary skill in the art, thereby allowing for varying rate control of hydraulic press 200 from a distance. In another exemplary embodiment, the switch activates a fracturing device control unit which can be programmed to execute a sequence of stroke steps, apply a constant force, ramp the force at a specified rate, check for contact with an IED as described herein, deactivate to maintain force, and/or set a duration time for each stroke position in the lateral direction thereby in one implementation automatically performing the steps 508-520 of FIG. 5. As described further herein, once in position, hydraulic press 200 moves fracturing device 216 into contact with an IED secured within bed 214 such that the IED fractures and dispels its explosive filler, thereby rendering the IED safe for disposal.

It is noted that although hydraulics is discussed in this example, those of skill in the art would understand that pneumatics or electric motors can alternatively be used (in place or in addition to hydraulics) to generate mechanical advantage through gears and create the force required to fracture the IEDs as explained herein without departing from the scope of the present subject matter.

FIGS. 3A-3H illustrate a variety of exemplary fracturing devices configured to be utilized by one or both of first hydraulic press 100 and second hydraulic press 200 to fracture and render safe an IED. The fracturing devices are configured to be mated to one or both of the first hydraulic press 100 and second hydraulic press 200 via corresponding stems as would be understood by one of ordinary skill in the art. Each fracturing device described herein has a unique geometry which is configured to control any applied forces and reduce friction while maintaining the strength of the fracturing device. As explained further herein, different types of fracturing devices are utilized based on a variety of factors including, but not limited to, the type of IED, the type of explosive filler and environmental conditions. Although having their own identifiers for clarity, any of the fracturing devices described below can be substituted for fracturing device 106 or fracturing device 216. Further, like designations are repeated for similar parts between different fracturing devices.

Figure 3A:
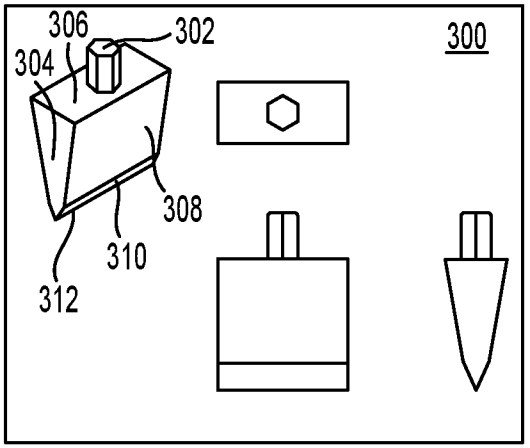
FIG. 3A illustrates an exemplary first fracturing device.

FIG. 3A illustrates an exemplary first fracturing device 300 for use with one or both of first hydraulic press 100 and second hydraulic press 200. The first fracturing device 300 utilizes a wedge geometry and is secured to hydraulic cylinder 112 and hydraulic ram 222 via a stem 302. First fracturing device 300 has a body 304 comprised of an upper surface 306 connected to stem 302 and having a multi-tiered taper, thereby creating a first taper 308 and second taper 310 forming a linear tip 312. First taper 308 is wider near the upper surface 306 to enhance the connection to first hydraulic press 100 and second hydraulic press 200 while enhancing the overall strength of first fracturing device 300. Second taper 310 is machined such that more strain is applied at tip 312, thereby enhancing the ability to effectively fracture an IED upon contact. Device 300 is a general-purpose wedge configured be used for multiple types of IEDs including, for example, steel pipe bombs. In the exemplary embodiment shown, the wedge is shaped to apply a constant mechanical advantage factor to an IED. The second taper also increases the toughness of the wedge geometry. By combining the first and second taper, the overall strength of the wedge is increased to prevent it from failing and/or breaking. The wedge length to width ratio allows the device 300 to cause material failure of an IED with the least amount of stroke.

Figure 3B:
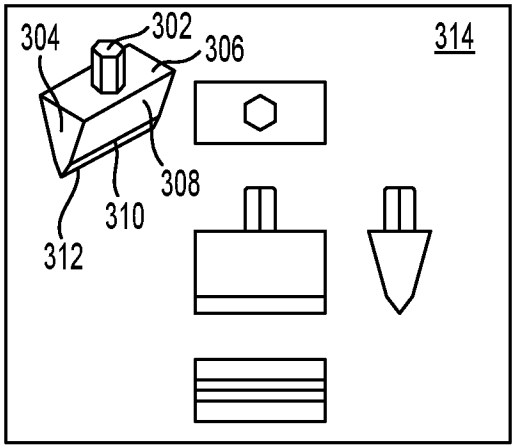
FIG. 3B illustrates an exemplary second fracturing device.

FIG. 3B illustrates a second exemplary fracturing device 314 for use with the first hydraulic press 100 and/or second hydraulic press 200. The second fracturing device 314 utilizes a wedge geometry and is secured to hydraulic cylinder 112 and hydraulic ram 222 via a stem 302. Second fracturing device 314 includes a body 304 comprised of an upper surface 306 connected to stem 302 and has a multi-tiered taper, thereby creating a first taper 308 and second taper 310 forming a linear tip 312. First taper 308 is wider near the upper surface 306 to enhance the connection to first hydraulic press 100 and/or second hydraulic press 200, while enhancing the overall strength of second fracturing device 314. Second taper 310 is machined such that more force is applied at tip 312, thereby enhancing the ability to effectively fracture an IED upon contact. The profile of second taper 310 is curved so that as the fracturing device 314 progresses through the bomb's sidewall strain increases exponentially as the wedge moves through the bomb casing. The fracture strain/elongation to break is reached more quickly with a curved taper and the wedge intrusion into the bomb is minimized before material failure as the bomb falls apart. The fracturing device 314 is therefore less likely to impinge on the explosives as the bomb breaks open.

Figure 3C:
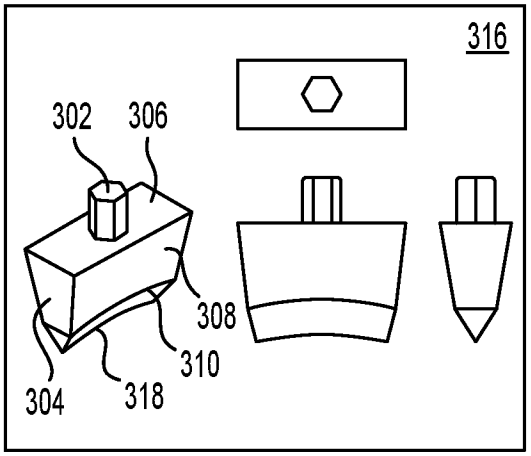
FIG. 3C illustrates an exemplary third fracturing device.

FIG. 3C illustrates a third exemplary fracturing device 316 for use with the first hydraulic press 100 and/or second hydraulic press 200. Third fracturing device 316 utilizes a wedge geometry and is secured to hydraulic cylinder 112 and hydraulic ram 222 via stem 302. Third fracturing device 316 includes a body 304 comprised of an upper surface 306 connected to stem 302 and a multi-tiered taper including a first taper 308 and a second taper 310 forming a non-linear tip 318. First taper 308 is wider near the upper surface 306 to enhance the connection to first hydraulic press 100 and/or second hydraulic press 200 while enhancing the overall strength of third fracturing device 316. Second taper 310 is configured such that more force is applied at the tip 318, thereby enhancing the ability to effectively fracture an IED upon contact. Further, non-linear tip 318 is configured to have a parabolic curvature which provides more contact points on curved IED devices, thereby enhancing the ability of fracturing device 316 to fracture a curved IED. The IEDs are trapped within the curved region and can't slip out from under the fracturing device 315, thereby reducing the risk of activation of the IED.

Figure 3D:
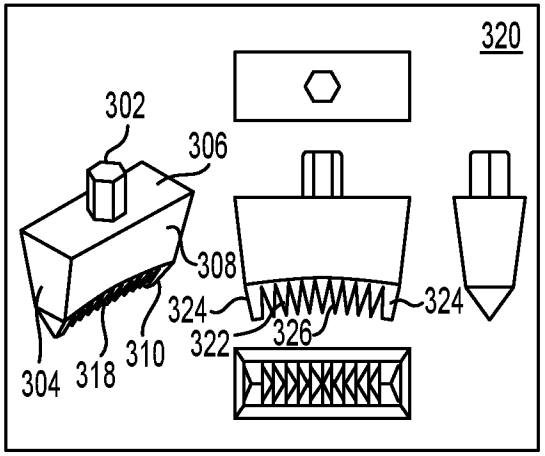
FIG. 3D illustrates an exemplary fourth fracturing device.

FIG. 3D illustrates a fourth exemplary fracturing device 320 for use with first hydraulic press 100 and/or second hydraulic press 200. Fourth fracturing device 320 utilizes a wedge geometry and is secured to hydraulic cylinder 112 and hydraulic ram 222 via a stem 302. Fourth fracturing device 320 has a body 304 including an upper surface 306 connected to stem 302 and having a first taper 308 and a second taper 310 forming a non-linear tip 318. First taper 308 is wider near the upper surface 306 to enhance the connection to first hydraulic press 100 and/or second hydraulic press 200 while enhancing the overall strength of fourth fracturing device 320. Second taper 310 is configured such that more force is applied at tip 318, thereby enhancing the ability to effectively fracture an IED upon contact. Non-linear tip 318 is configured to have a parabolic curvature which provides more contact points on curved IED devices, thereby enhancing the ability of the fracturing device to fracture a curved IED. Certain exemplary embodiments include a plurality of teeth 322 machined into non-linear tip 318 of fourth fracturing device 320. Exterior teeth 324 enclose a plurality of interior teeth 326 machined to a point. In addition to the aforementioned advantageous features of the non-linear tip 318, the plurality of teeth 322, particularly the interior teeth 326, further enhance fracturing capability by concentrating pressure on the IED at the interior teeth 326. The interior teeth 326 also bite into the material of an IED to prevent movement of oval, spherical or other oddly shaped IEDs during operation of the first hydraulic press 100 or second hydraulic press 200, thereby reducing the risk of activation of the IED.

Figure 3E:
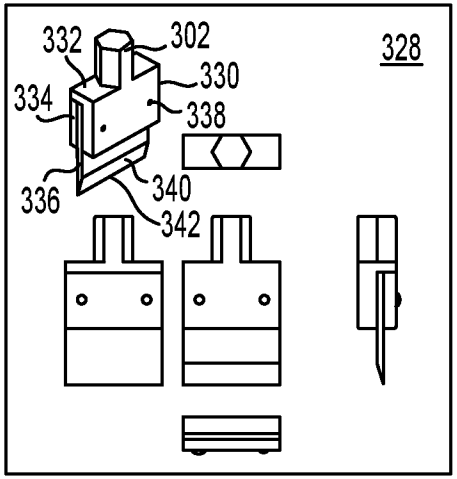
FIG. 3E illustrates an exemplary fifth fracturing device.

FIG. 3E illustrates a fifth exemplary fracturing device 328 for use with first hydraulic press 100 and/or second hydraulic press 200. Fifth fracturing device 328 has a bladed geometry and is secured to hydraulic cylinder 112 and hydraulic ram 222 via a stem 302. Fifth fracturing device 328 has a symmetrical body 330 comprised of an upper surface 332 connected to stem 302 and a cavity 334 extending along an interior length of body 330. Cavity 334 is machined into an interior portion of body 330 and configured to receive a blade 336, which is configured to be affixed in the interior of cavity 334 via a fastener 338 such as a screw or bolt or, in some implementations, may be welded to the interior walls of cavity 334. In certain exemplary embodiments blade 336 has a tapered portion 340 which tapers to a linear tip 342. Tapered portion 340 is configured such that more force is applied at tip 318, thereby enhancing the ability to effectively fracture an IED upon contact. Certain highly ductile materials and soft IED casings, such as copper or cardboard tubing, can significantly crimp when contacted with a wedge geometry fracturing device. This crimped portion obstructs the flow of explosive material which needs to be removed for safety and can in turn create two IEDs. Further, crimping prevents the inspection and confirmation that the IED is empty after expulsion of the material inside. Accordingly, use of blade 336 results in the IED being trapped, allowing for a slicing action as blade 336 progresses. Use of tapered portion 340 results in a steady increase in pressure as the IED gets closer to the tip 342 of the blade 336. In the embodiment, blade 336 includes a single beveled edge.

Figure 3F:
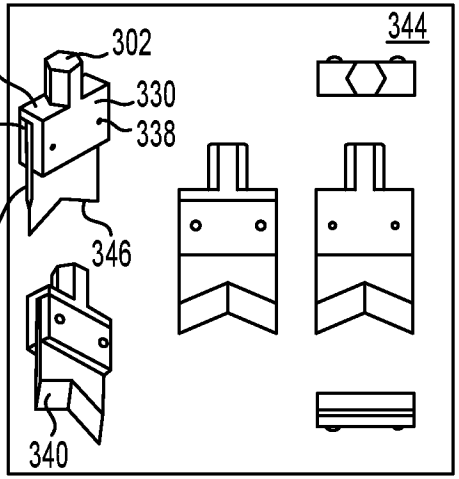
FIG. 3F illustrates an exemplary sixth fracturing device.

FIG. 3F illustrates a sixth exemplary fracturing device 344 for use with first hydraulic press 100 and/or second hydraulic press 200. Sixth fracturing device 344 includes a bladed geometry and is secured to hydraulic cylinder 112 and hydraulic ram 222 via a stem 302. Sixth fracturing device 344 has a symmetrical body 330 comprised of an upper surface 332 connected to stem 302 and a cavity 334 and extending along an interior length of body 330. Cavity 334 is machined into an interior portion of body 330 and configured to receive a blade 336, which is configured be affixed therein via, e.g., a fastener 338 such as a screw or bolt or, in some implementations, welded to the interior walls of cavity 334. In certain exemplary embodiments blade 336 includes a tapered portion 340 which tapers to a non-linear tip 346. The tapered portion 340 is configured such that more force is applied at tip 346, thereby enhancing the ability to effectively fracture an IED upon contact. Certain highly ductile materials and soft IED casings, such as copper or cardboard tubing, can significantly crimp when contacted by a wedge geometry fracturing device. This crimped portion obstructs the flow of explosive material which needs to be removed for safety and can in turn create two IEDs. Further, crimping prevents inspection and confirmation that the IED is empty after expulsion of the material inside. Accordingly, blade 336 traps the IED in place, allowing for a slicing action as blade 336 progresses, therefore reducing the likelihood of crimping the IED. Tapered portion 340 is configured to apply a steady increase in pressure as the IED gets closer to the apex of blade 336. Further, the non-linear tip 346 helps to secure oddly shaped IEDs upon contact by sixth fracturing device 344 and also results in a slicing action, thereby improving the effectiveness of fracturing the IED while reducing the risk of activation of the IED. Blade 336 is also a single beveled edge which has a higher mechanical advantage over a double beveled edge.

Figure 3H:
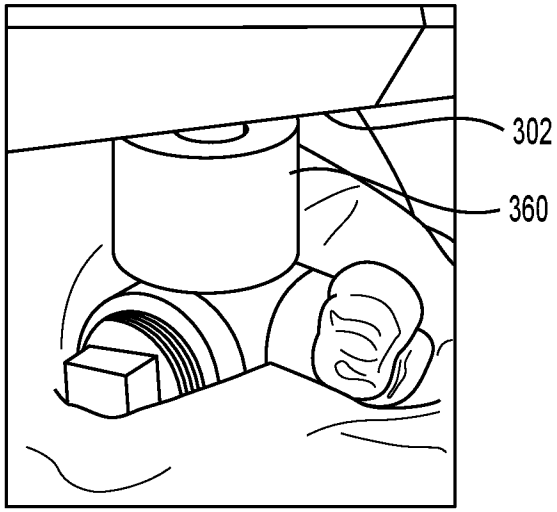
FIG. 3H illustrates an exemplary press.
Figure 3G:
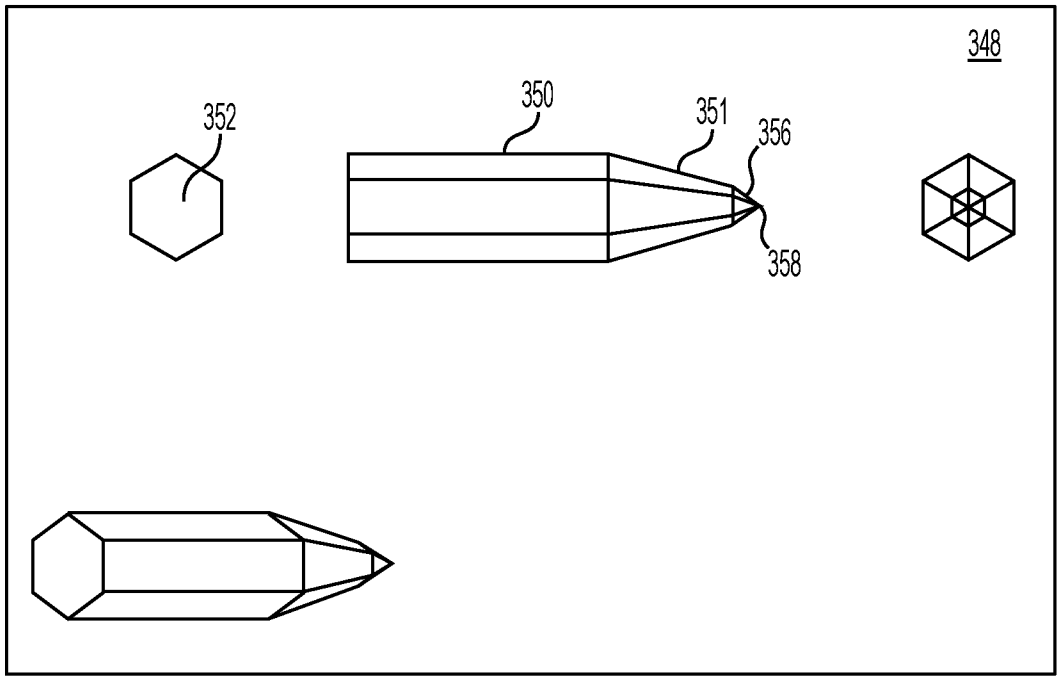
FIG. 3G illustrates an exemplary puncturing device.

FIG. 3G illustrates an exemplary fracturing device 348 for use with first hydraulic press 100 and/or second hydraulic press 200. Fracturing device 348 has a hexagonal shape and elongated body 350 extending from an upper surface 352 which is secured to the hydraulic cylinder 112 and hydraulic ram 222. Alternative body 350 shapes are contemplated herein and can be used without departing from the scope of the present subject matter. In the exemplary embodiment shown, fracturing device 348 further includes a first taper 351 which terminates at the start of a second taper 356 which terminates at a tip 358. Second taper 356 is configured such that the majority of force is applied at tip 358, thereby enhancing the ability to effectively fracture by puncturing an object upon contact. Some IEDs or other containers may contain liquids, fine filler such as for example propellant, or other chemicals that produce gases to pressurize the bomb container. Fracturing device 348 is configured to rupture the IED casing and provide a hole for the liquid, filler and/or vapor to leak out of the IED. In the case of pressurized vessels, such as propane tanks or acid bombs, puncturing the side of the container relieves the pressure in the vessel and allows flammable or compressed gas to escape.

FIG. 3H illustrates an exemplary fracturing device 360 for use with first hydraulic press 100 and/or second hydraulic press 200. Fracturing device 360 has a rounded cylindrical shape and elongated body secured to hydraulic cylinder 112 and hydraulic ram 222 via stem 302. Fracturing device 360 has a blunted shape configured to provide force over a wider area of an IED to render safe an IED upon activation of the hydraulic press. For example, when attempting to render safe IEDs containing highly reactive flash powder, fracturing device 360 is configured to crush the IED with an even distribution pattern, thereby minimizing the likelihood of a reaction by the flash powder.

Figure 4A:
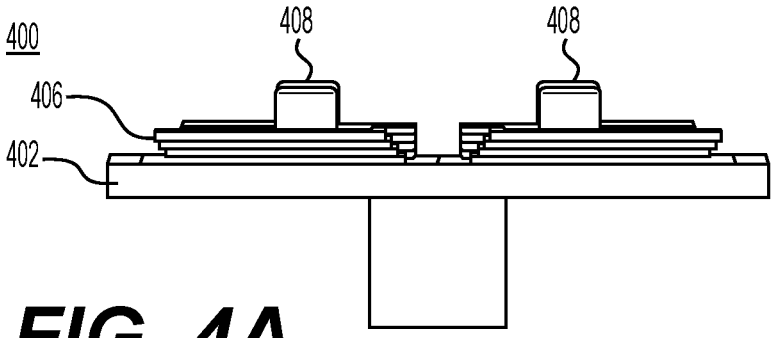
FIGS. 4A-4C illustrate an exemplary adjustable platform configured to receive an IED.
Figure 4B:
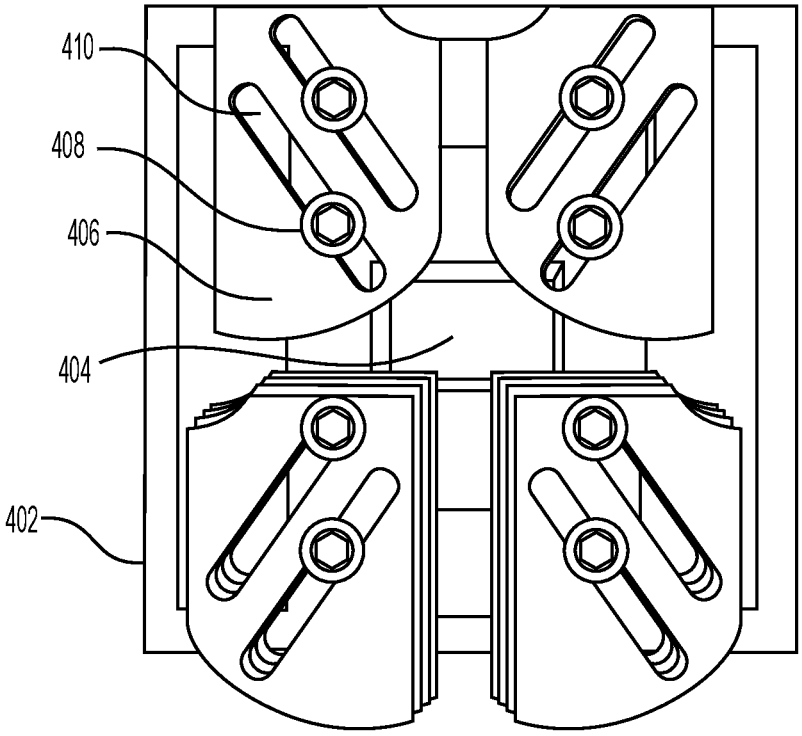
Figure 4C:
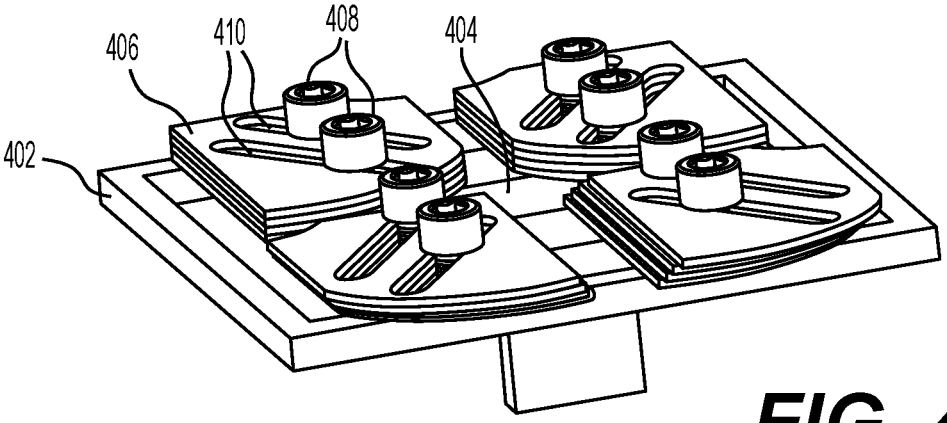

FIGS. 4A-4K illustrate exemplary platforms configured to receive an IED for use with first hydraulic press 100 and/or second hydraulic press 200 or another mechanical press. FIGS. 4A-C demonstrate an exemplary adjustable platform 400 configured to form intersecting 'V's or other shapes of curved channels. Platform 400 includes a base 402 with an optional hole 404 machined therein and one or more stackable profiled plates 406 configured to be stacked on base 402. Plates 406 are rotatable to varying locations on base 402 and are secured to the base 402 via fastening devices 408, such as screws or bolts for example, and in certain embodiments are secured within tracks 410 machined therein to form a variety of differently shaped channels. Fastening devices 408 are secured as would be understood by one of ordinary skill in the art by passing them through threaded or unthreaded holes (not shown) in the base 402 at various locations which are configured to receive the fastening devices 408. Optional hole 404 can be machined anywhere in base 402 and is configured to receive explosive filler or liquids contained within an IED once the IED is rendered safe.

Figure 4D:
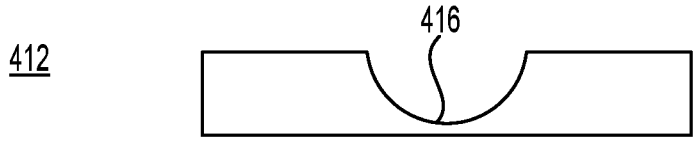
FIGS. 4D-4F illustrate an exemplary first shaped platform configured to receive an IED.
Figure 4E:
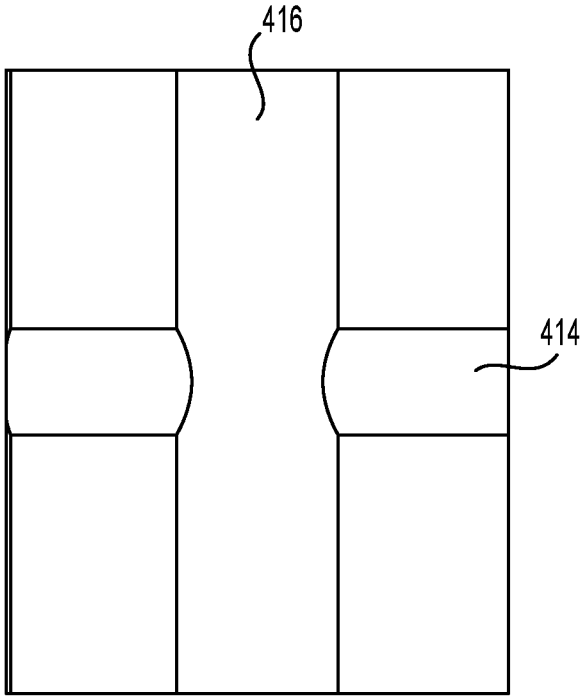
Figure 4F:
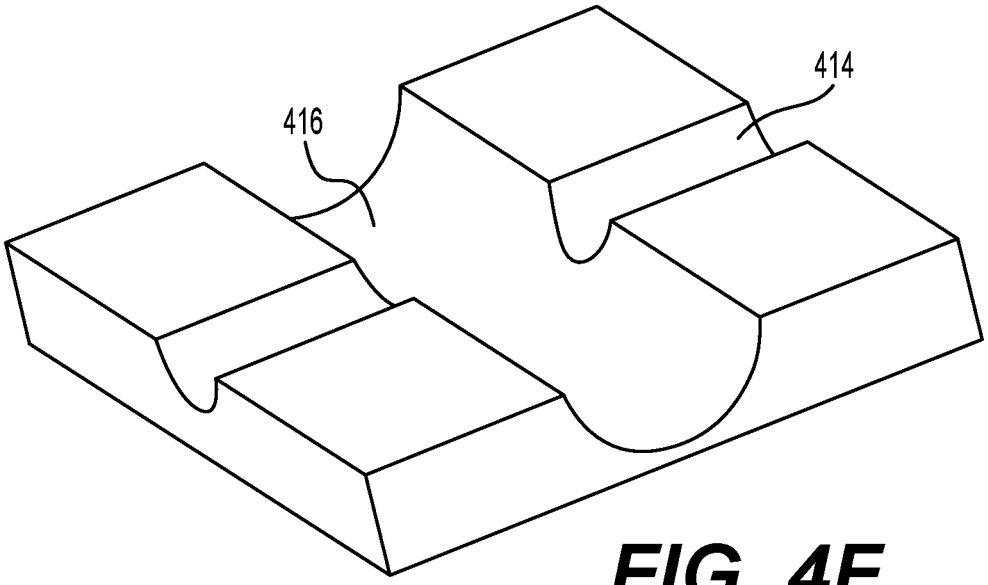

FIGS. 4D-4F illustrate an exemplary platform 412 having intersecting curved U-shaped channels 414, 416 formed from a steel block or cast in steel. Casting allows for reduced machining costs. Both cast and machined blocks can be shelled to reduce weight. The size of these channels can be changed by selecting different scaled blocks. The intersecting channels can be of a different size to increase flexibility in bomb sizes and shapes. The U-shaped channels 414, 416 are configured to receive one or more IEDs therein to secure IEDs being rendered safe by a hydraulic press. Alternatively, the blocks can be made of foam or rubber with custom shaped grooves or channels and will compress or deform to relieve undesired counterforces that would occur with a rigid block. The block sets the position of the target IED and after the wedge tip contacts with the IED skin, the target device can no longer move. The soft block readily deforms as the IED begins to change shape during the fracturing process. The IED parts move away from their original position. The soft blocks are elastic and return to their original shape after the wedge retracts.

Figure 4G:
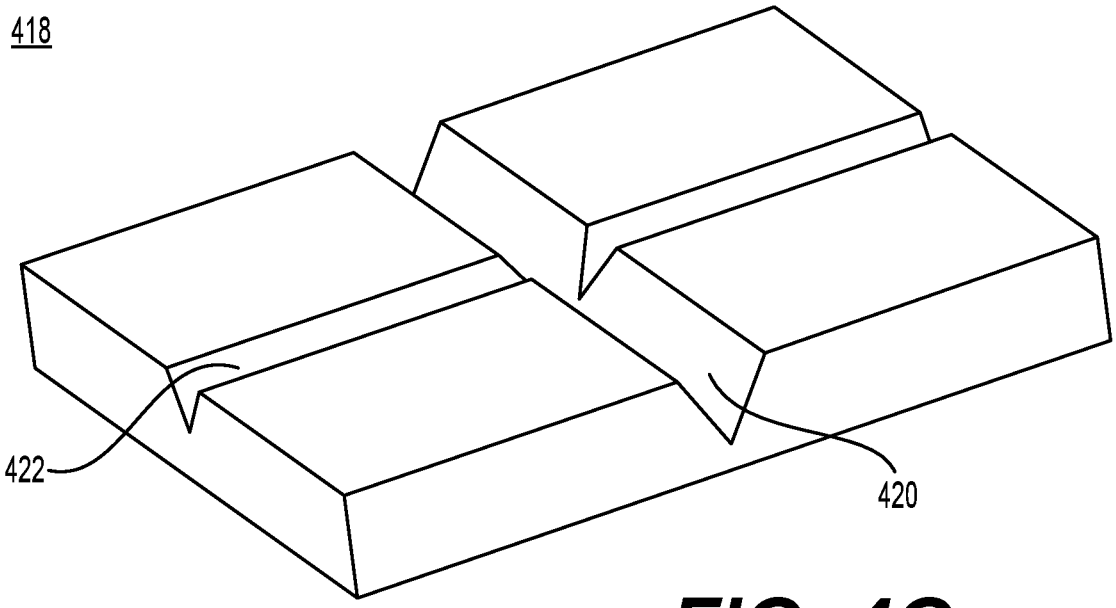
FIGS. 4G-I illustrate an exemplary second shaped platform configured to receive an IED.
Figure 4H:
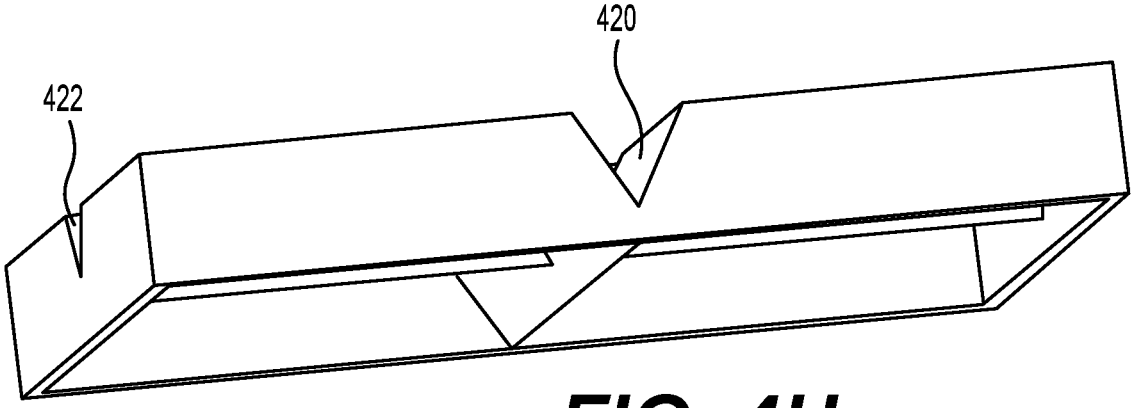
Figure 4I:
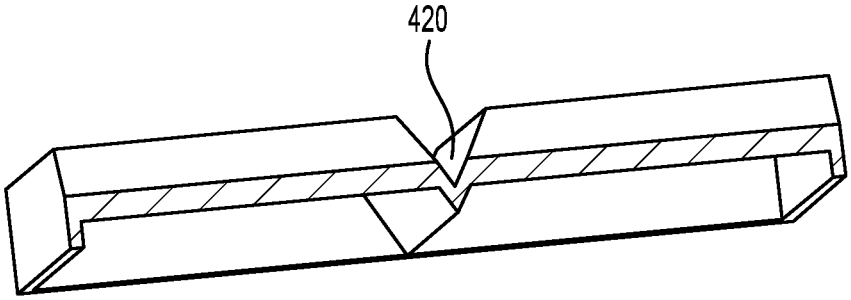

FIGS. 4G-4I illustrate an exemplary platform 418 having intersecting curved V-shaped channels 420, 422 formed from a steel block or cast in steel. Casting allows for reduced machining costs. Both cast and machined blocks can be shelled to reduce weight. The size of these channels can be changed by selecting different scaled blocks. In certain exemplary embodiments, intersecting channels are of different sizes to increase flexibility in bomb sizes and shapes. The V-shaped channels 420,422 are configured to receive one or more IEDs therein to secure said IEDs when being rendered safe by a hydraulic press.

Figure 4J:
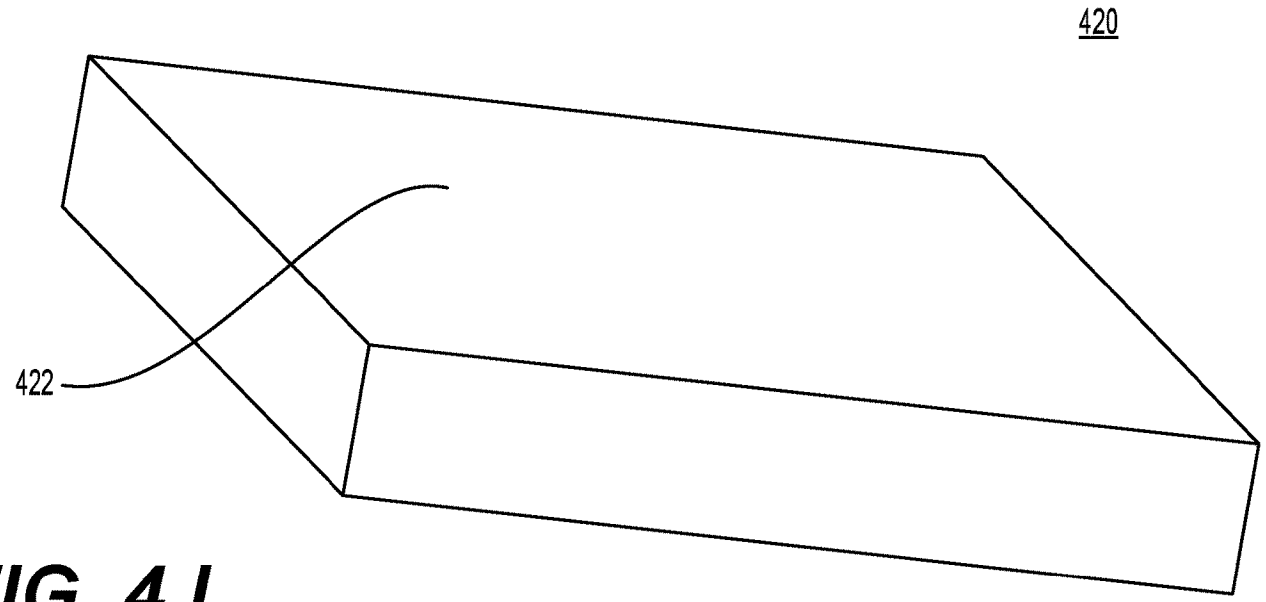
FIG. 4J illustrates an exemplary flat platform configured to receive an IED.
Figure 4K:
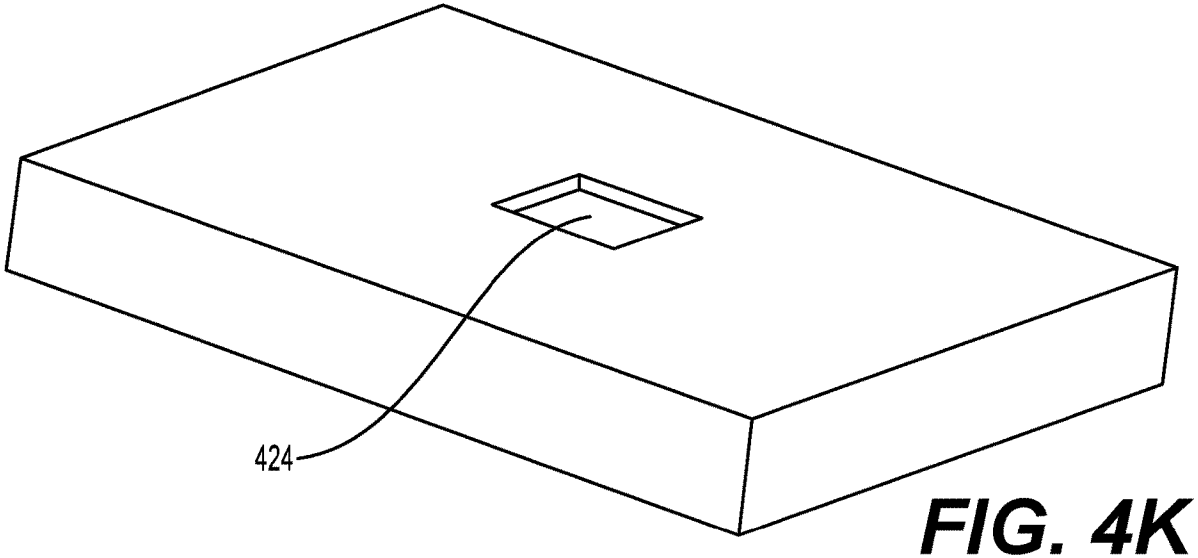
FIG. 4K illustrates an exemplary flat platform having a hole and being configured to receive an IED.

FIG. 4J illustrates an exemplary platform 420 including a flat plate 422 that is advantageous in certain applications for rendering safe select IEDs. For example, a flat plate 422 can be used with certain types of IEDs, such as pipe elbows, and provides the benefit of not creating a counterforce that constrains the IED being split apart when the fracturing device is applied to the IED. A shaped plate prevents IEDs, such as those comprised of pipe nipples, from rotating when the fracturing device is applied to the IED. However, the shaped plate channels may cause binding of IED portions being separated. This may result in needing higher reaction forces to fracture the IED. It should be noted that a hole can be machined into any of the platforms at any location to allow powders and liquids to flow away from the IED and into a trap as the IEDs are being rendered safe. FIG. 4K illustrates an example of the platform 420 having a hole 424 machined therein.

Figure 5:
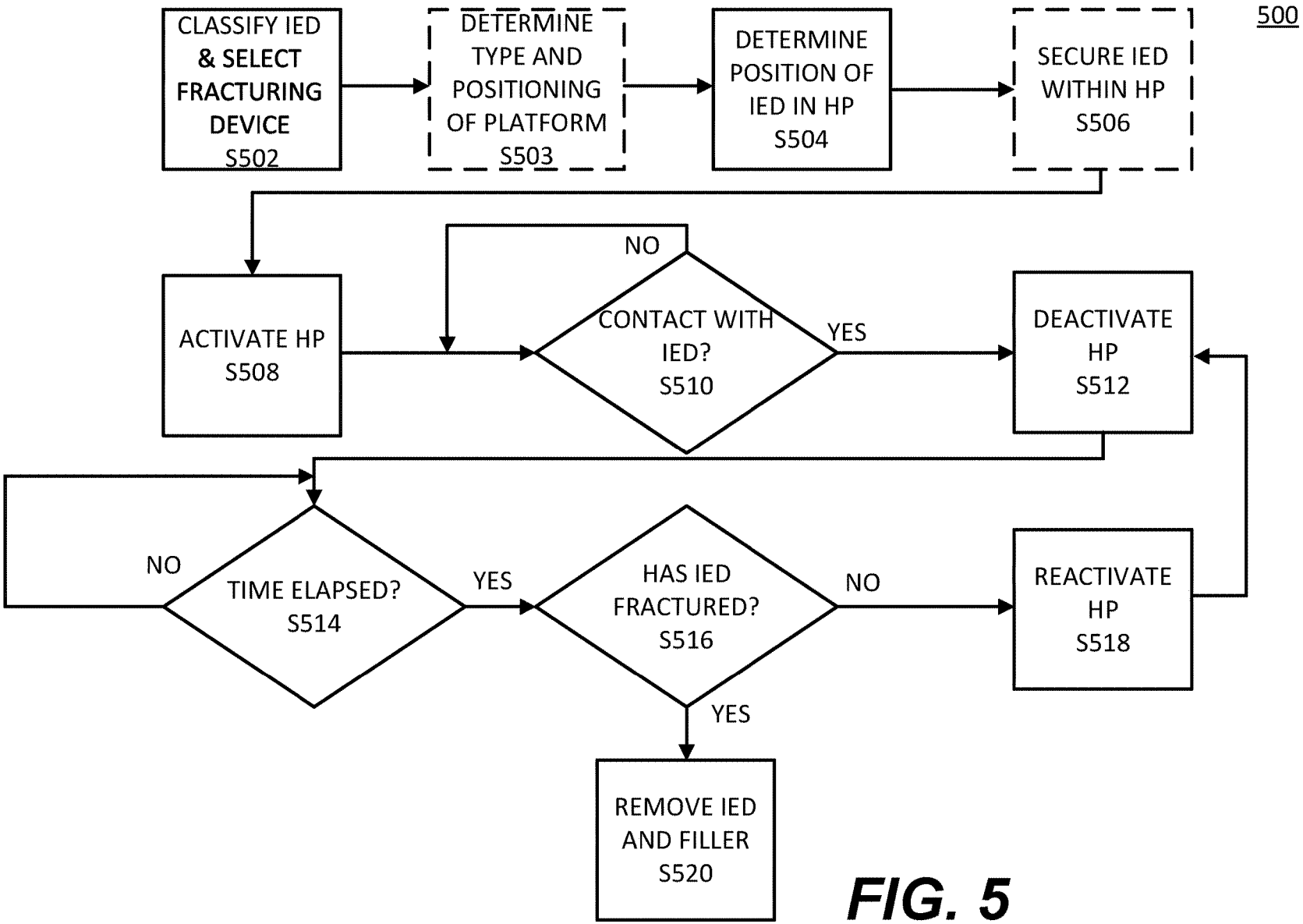
FIG. 5 illustrates an exemplary method to render safe IEDs.

FIG. 5 illustrates an exemplary method 500 for utilizing the first and/or second hydraulic press to render safe IEDs. For the purposes of explanation, it is assumed that the location of an IED has already been provided to a bomb technician by, for example, first responders or via a call center routing civilian or non-civilian reporting. Once the location of the IED is known and visual inspection can take place, a bomb technician classifies the IED at step S502. As used herein, a bomb technician may represent physically onsite personnel or virtually onsite personnel via a robot which can perform the steps described herein remotely such as for example IED positioning, switch control, and virtual inspection for fracturing. Classification involves, among other things, identifying the type of IED based on the structure of the IED as well as the composition of the IED. For example, the IED may be any type of hazardous device including, but not limited to, military ordnance, uncontrolled ordnance, street elbows, pipe nipples, cardboard based or copper, grenade replicas and PVC pipes. The type of the IED directly influences which type of fracturing device is secured to the hydraulic press to use to render safe the IED. As discussed herein, first fracturing device 300, second fracturing device 314, third fracturing device 316, and/or fourth fracturing device 320 may be chosen for IEDs formed of hard materials such as steel and iron to provide more force, whereas fifth fracturing device 328 and/or sixth fracturing device 344 may be chosen for IEDs made of more ductile materials such as copper to prevent crimping. However, it should be noted that the use of a particular fracturing device is not limited to the aforementioned selections.

The classification performed at step S502 also involves identifying the likely type of explosive filler used with the IED, which can include at least one of black powder, flash powder, and/or smokeless powder. The classification of the explosive filler also affects which type of fracturing device to secure to the hydraulic press, as one filler may be more sensitive to heat, compression, or friction than other fillers. For example, as flash powder is extremely sensitive to heat, impact, shock and friction, it is important that the IED not be crimped when attempting to render it safe. Accordingly, for flash powder, fifth fracturing device 328 and/or sixth fracturing device 344 are least likely to create friction and crimping of the IED, therefore minimizing the likelihood of igniting the flash powder contained therein. However, first through fourth fracturing devices are still effective and can also render safe IEDs containing flash powder. Additionally, if the bomb technician determines at step S502 that the IED contains liquid or gases, the fracturing device 348 is often selected in order form a hole for liquid to leak out or to allow flammable or compressed gases to escape from the IED.

The classification at step S502 also involves determining current environmental conditions, which sometimes dictate which fracturing device to secure to the hydraulic press used to render safe the IED. For example, extremely cold conditions, such as near or below freezing, may make even ductile IEDs more brittle, thereby resulting in one or more of first through fourth fracturing devices 300,314,316,320 being selected to render safe the IED rather than one or more of fifth and/or sixth fracturing devices 328,344. However, extremely hot (i.e., 90 degrees F. or greater) and/or muggy conditions (i.e. a dewpoint of 70+) may result in hard materials becoming more ductile, thereby leading a bomb technician to select one or more of fifth and/or sixth fracturing devices 328,344 to avoid potential crimping of the IED.

Accordingly, at step S502, based on one or more of the factors discussed above, it is determined which fracturing device to secure to the hydraulic press for the particular circumstances present at the time of rendering safe an IED. Different fracturing devices may be used at one location (or different locations) for different IEDs based on the circumstances by removing the existing fracturing device from the hydraulic press and securing a different fracturing device. Further, the actual securing of the chosen fracturing device can be performed at the time of determination at step S502 or at any other time before activation of the press at step S508.

After the IED is classified, and a fracturing device is chosen at step S502, it is then optionally determined at step S503 whether to use a platform with the hydraulic press to secure the IED and/or to provide a guide for expulsion of the explosive filler. The decision to use a platform and type of platform to be used depends on the type of IED and explosive filler. For example, platform 400 illustrated in FIGS. 4A-C has ample adjustability via the maneuverable plates 406 to form a custom channel having a desired profile for a particular IED to be positioned thereon. Accordingly, platform 400 allows for flexibility on site to successfully position and render safe a variety of IEDs of different sizes and shape profiles. Rounded objects such as grenade bodies are often fixed into position over optional hole 404 using oval and/or circular profiled intersecting channels formed via maneuverable plates 406. Steel pipe nipples or other IEDs of similar design are often captured using platforms 412 or 418 having intersecting 'U'(FIGS. 4D-4F) or 'V'-shaped channels (FIGS. 4G-4I). Whether to use a U-shaped platform 412 or V-shaped platform 418 often depends upon the profile of the IED as to whether it may move within a particular channel. In instances that require application of an equal pressure throughout, platform 420 is an effective platform to use (for example for elbow pipe bombs) (see, e.g., FIG. 4J). In certain instances, a platform shaped to address specific military or uncontrolled ordnance can be formed by either by casting or machining metal or using variable platform 400. The type of IED can dictate whether a platform having a hole, such as platform 420, should be used for the disposing of any explosive expulsed from the fractured IED.

Next it is determined at step S504 how to position the IED within a particular hydraulic press. Thus, the bomb technician determines at step S504 how to position the IED within cradle 104 on base plate 102 or within bed 214 in space 211 (or on optional platform). For the purposes of explanation with respect to method 500, first hydraulic press 100 is used as an example, although the same methodology applies to second hydraulic press 200 or other mechanical presses. The positioning is important as the IED must be placed so that a particular portion of the IED aligns with the particular fracturing device. This provides the best chance for fracture without detonating the IED. Exemplary illustrations of positioning of an IED with respect to a corresponding hydraulic press is provided in FIGS. 6-12, which illustrate different types of IEDs having different types of explosive fillers both before and after being rendered safe, and the particular positioning of the particular fracturing device. FIGS. 6-9 illustrate the results using first hydraulic press 100, whereas FIGS. 10-12 illustrate the results using second hydraulic press 200. However, either hydraulic press could be used on any of the IEDs illustrated to render safe the IEDs without departing from the scope of the present subject matter.

Once the location for placing the IED has been determined and the IED is positioned within cradle 104 on base plate 104 (or optional platform) in line with the fracturing device 106 at step S504, the IED may optionally be secured via a fastening device such as, for example, by using clamp 103. The determination of whether to secure the IED depends on various factors such as the type of IED and how likely it is to move on its own (i.e., cylindrical PVC IEDs, circular replica grenade IEDs) and environmental conditions such as wind. Once optional step S506 is completed, the hydraulic press is activated at step S508.

As described herein, activation of switch 108 at step S508 causes hydraulic cylinder 112 to displace fracturing device 106 linearly along cradle 104 via hydraulic pressure toward the IED positioned on base plate 102 (or optional platform). Activation is maintained via switch 108 until fracturing device 106 contacts the IED. In certain embodiments, fracturing device 106 is stopped upon contacting the IED, as too much force could push through the IED to the explosive filler and result in detonation of the IED. Accordingly, in certain exemplary methods, care is taken to determine when contact between fracturing device 106 and IED takes place at step S510. There are various ways contemplated herein to determine whether there is contact between fracturing device 106 and the IED. One approach to identifying such contact is to analyze feedback from engine 110, which in certain exemplary embodiments takes the form of audio and/or vibrational feedback. Audio cues relate to changing sounds from engine 110 indicating that the burden of moving fracturing device 106 has increased, thus requiring additional energy. Vibrational cues relate to force-feedback imparted to switch 108 via the increased burden of the engine 110 attempting to continue moving fracturing device 106. Further, visual detection can be used in addition to and/or in place of the audio and/or vibrational feedback to identify if contact between fracturing device 106 and IED has occurred. If it is determined at step S510 that fracturing device 106 has not yet contacted the IED, activation of the hydraulic press 100 is maintained until it is determined that contact has occurred. However, if it is determined at step S510 that there is contact between fracturing device 106 and the IED, or if feedback indicates that fracturing device 106 is at a fracture position, hydraulic press 100 is deactivated at step S512 via release of switch 108 which maintains the pressure on the IED via the fracturing device.

Additional methods are contemplated herein for determining that fracturing device 106 has come into contact with the IED. For example, in certain exemplary embodiments one or more sensors (not shown) incorporated into hydraulic press 100 provide digital feedback to a controller within hydraulic press 100 which, upon detecting audio feedback and/or vibrational feedback above a certain threshold, would deactivate engine 110, thereby pausing motion of fracturing device 106. One non-limiting example of a vibrational sensor is the Fluke® 3561 FC Vibration Sensor. One non-limiting example of the audio feedback sensor for implementing the features described herein is the Waveshare® sound sensor.

In certain exemplary embodiments, operation is accomplished automatically via a driving microcontroller or CPU microprocessor which monitors the applied force via force transducers on the ram head. The ram head is the portion of the ram of the hydraulic press that abuts an end effector such as the wedge stem 302. The transducer is sandwiched between the ram head and the base of the end effector. Optionally, or in addition to, a transducer could be located on any of the platforms illustrated in FIGS. 4A-4K for which the CPU would monitor applied force to the platform. The microcontroller of microprocessor uses the feedback to assign the rate of applied force, amplitude of the force, duration of force, and/or control distance of travel (stroke) in a step to minimize risk of ignition and optimize fracturing. In certain of these exemplary embodiments, a feedback transducer (not shown) provides input to a processer which drives the output of the press in conjunction with an internal timer set under conditions described herein.

Once hydraulic press 100 is deactivated at step S512, contact between fracturing device 106 and the IED is maintained for a predetermined period of time at step S514. In one exemplary embodiment, the period of time is one to two minutes. However, the time can vary based on the type of IED and the type of explosive filler without departing from the scope of the present subject matter. For example, more ductile IEDs, such as copper, can involve longer time periods which require additional time for fracture without risking the crimping of the IED. Also, as flash power is incredibly reactive and unsafe, the time period is extended to allow for the chance for fracture without risking detonation. Further, extremely cold conditions (below freezing, for example) can result in the IED becoming more brittle which may lower the period of time for contact, whereas hot conditions (i.e., 90 F+) could result in an increase in the period of time for contact due to material effects of the heat.

Once the predetermined period of time has elapsed at step S514 it is determined whether the IED has fractured at step S516. The time period can be monitored manually or via a timer (not shown) included in hydraulic press 100. In certain exemplary embodiments the timer provides an audio and/or visual indication when the time period has elapsed. Fracture can be determined by observing breakage of the IED resulting in the explosive filler being exposed. If it is determined at step S516 that the IED has sufficiently fractured, the IED and explosive filler are removed at step S520 and the IED is considered rendered safe. If it is determined at step S516 that the IED has not sufficiently fractured, then hydraulic press 100 is temporarily reactivated at step S518 via switch 108 to apply additional force to the IED via fracturing device 106 before again deactivating to maintain the force on the IED. Thus, in this instance, the period of time is reset to zero and steps S512 and S516 are repeated. If the time period again elapses without fracture, step S518 is repeated by reactivating hydraulic press 100 and repeating the process. This process is repeated until it is determined that the IED has fractured at step S516, at which point the explosive filler is removed at step S520. Step S518 may in one example entail executing a sequence of stroke steps of equal or differing length with pauses of time (step S514) between movements. Step S518 may optionally in one example constitute applying a constant force, or ramping the force at a specified rate. In certain exemplary methods, the rate of application of the fracturing device 106 is adjusted based on a level of activation of switch 108 based on the type of IED and/or explosive filler. For example, for cardboard based IEDs and more ductile IEDs, the rate at which pressure is applied to the IED via fracturing device 106 may be lower as compared to steel IEDs to reduce the risk of crimping. Further, the rate may be inhibited to lower levels when the IED contains flash powder to lower the risk of puncturing the IED and detonating the flash powder. Faster rates may be utilized for harder IEDS, such as steel, which contain less reactive explosive filler.

Figure 6A:
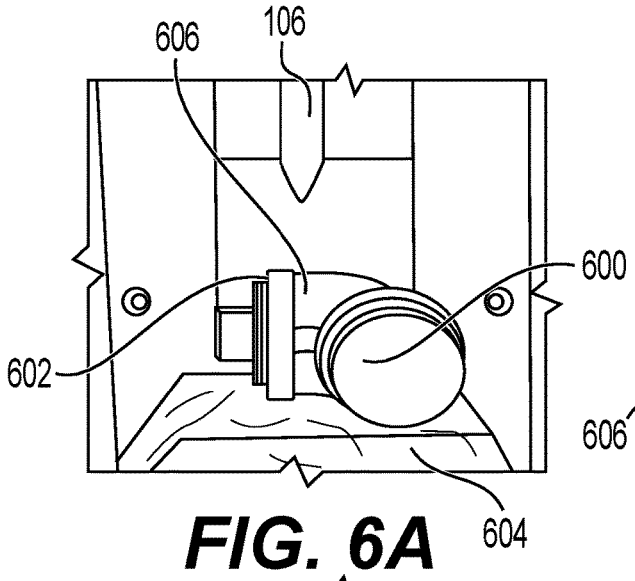
FIG. 6A illustrates an exemplary first IED positioned within the first hydraulic press prior to being rendered safe.
Figure 6B:
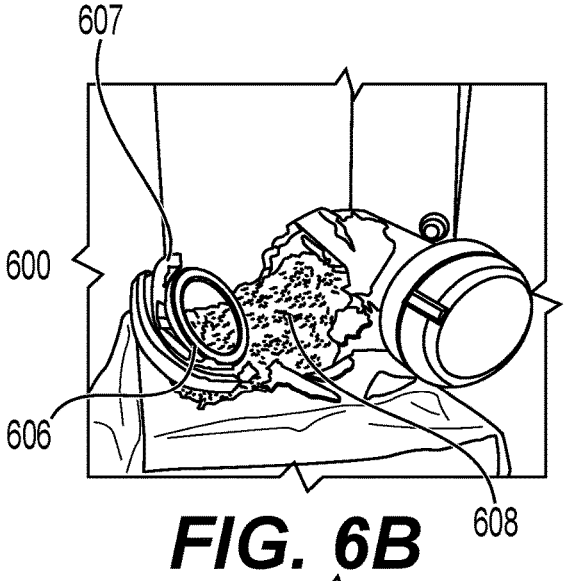
FIG. 6B illustrates the first exemplary IED after being rendered safe.

FIG. 6A illustrates a first exemplary IED 600 positioned within first hydraulic press 100 prior to the IED being rendered safe. In this example, the IED 600 is a 2-inch diameter steel street elbow containing FFFg black powder. The elbow was sealed with a 2-inch steel external end cap 602 and corresponding internal steel plug (not shown). As illustrated, the IED 600 is positioned at step S504 on optional platform 604 located on base plate 102 such that the tip of the fracturing device 106 is vertically in line with the area 606 just behind the flange of the internal plug side of the IED 600. The positioning of the IED 600 provides the most effective chances for fracture upon application of the fracturing device 106. Similarly, when the IED is comprised of a pipe fitting that is internally threaded on at least one end, the fracturing device is positioned in line with a position adjacent a flange of an internal plug side of the pipe fitting FIG. 6B illustrates the IED 600 after being rendered safe by first hydraulic press 100 according to one example. As shown in FIG. 6B, the IED 600 fractured precisely at the area 606 behind flange 607 at which pressure was applied by fracturing device 106, resulting in the safe expulsion of explosive filler 608.

Figure 7A:
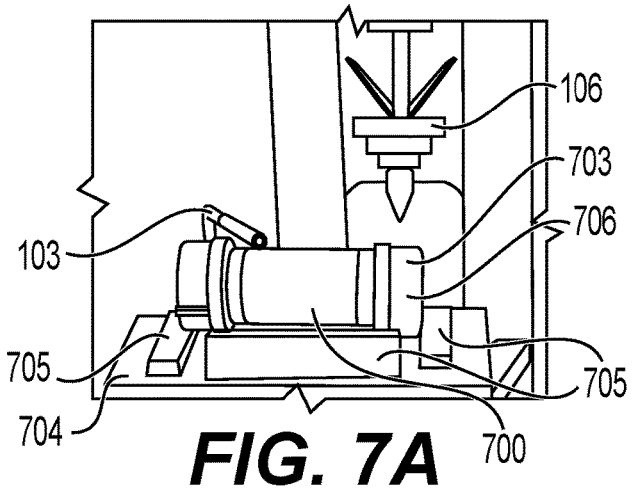
FIG. 7A illustrates a second exemplary IED positioned within the first hydraulic press and secured via a clamp prior to being rendered safe.

FIG. 7A illustrates a second exemplary IED 700 positioned within first hydraulic press 100 prior to the IED being rendered safe. In this example, the IED 700 is a 2-inch diameter 6-inch long schedule 40 steel pipe nipple containing FFFg black powder. As illustrated, the IED 700 is positioned at step S504 on optional platform 704 located on base plate 102 such that the tip of the fracturing device 106 is vertically in line with the area 706 over the middle of the end cap 703 of the IED 700. As illustrated, the platform 704 is placed to align the area 706 with the fracturing device 106 and has multiple walls 705 for holding and securing the IED 700 at the appropriate position. The positioning of exemplary IED 700 provides the most effective chances for fracture upon application of the fracturing device 106. In this example, and to ensure the IED 700 was secured when apply the fracturing device 106, clamp 103 is rotated over the IED 700 to hold it in place while IED 700 is being rendered safe.

Figure 7B:
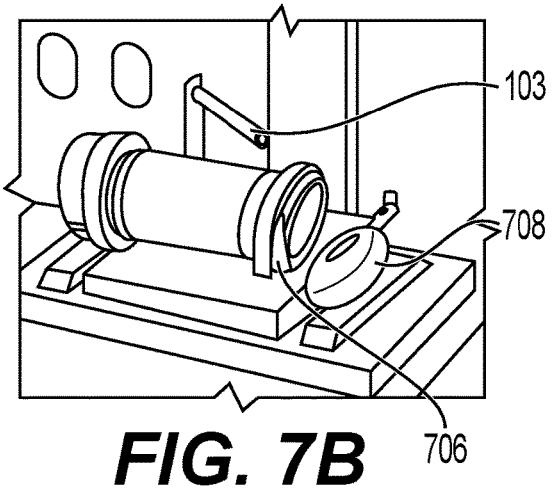
FIG. 7B illustrates the second exemplary IED after being rendered safe.

FIG. 7B illustrates the second IED 700 after being rendered safe by first hydraulic press 100. As shown in FIG. 7B, the IED 700 fractured precisely at the area 706 at which pressure was applied by fracturing device 106, resulting in the safe expulsion of explosive filler 708. Also illustrated is the vertical displacement of the clamp 103 to a non-securing position so that there is easier access to the fractured IED 700 to remove the IED and the explosive filler.

Figure 8A:
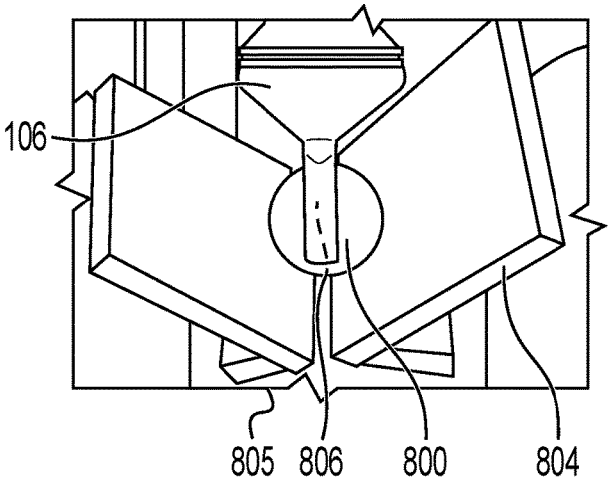
FIG. 8A illustrates a third exemplary IED positioned within the first hydraulic press prior to being rendered safe.

FIG. 8A illustrates a third exemplary IED 800 positioned within first hydraulic press 100 prior to IED 800 being rendered safe. In this example, the IED 800 is a M67 style "baseball" cast steel replica grenade body containing FFFg black powder and sealed with an inert grenade fuze (not shown) screwed into the top threads and a wooden plug in a bottom hole 805. As illustrated, the IED 800 is positioned at step S504 on optional platform 804 located on base plate 102 such that the tip of the fracturing device 106 is vertically in line with the area 806 near the center of mass while avoiding the fuze which aligns with bottom hole 805. Here, the platform 804 provides the added advantage of acting as a guide and repository for any explosive filler that falls from the fractured IED 800. The positioning of the IED 800 provides the most effective chances for fracture upon application of the fracturing device 106.

Figure 8B:
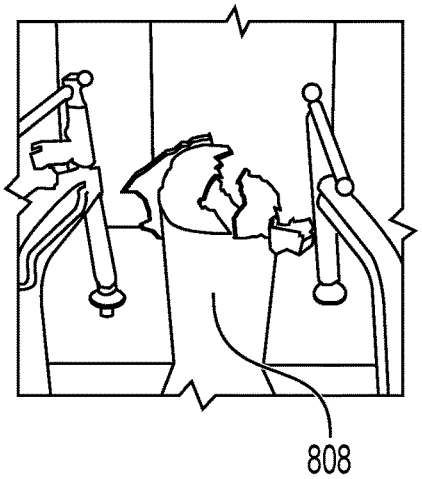
FIG. 8B illustrates the third exemplary IED after being rendered safe.

FIG. 8B illustrates the third IED 800 after being rendered safe by first hydraulic press 100 according to one example. As shown in FIG. 8B, the IED 800 fractured precisely at the area 806 at which pressure was applied by fracturing device 106, resulting in the safe expulsion of explosive filler 808.

Figure 9A:
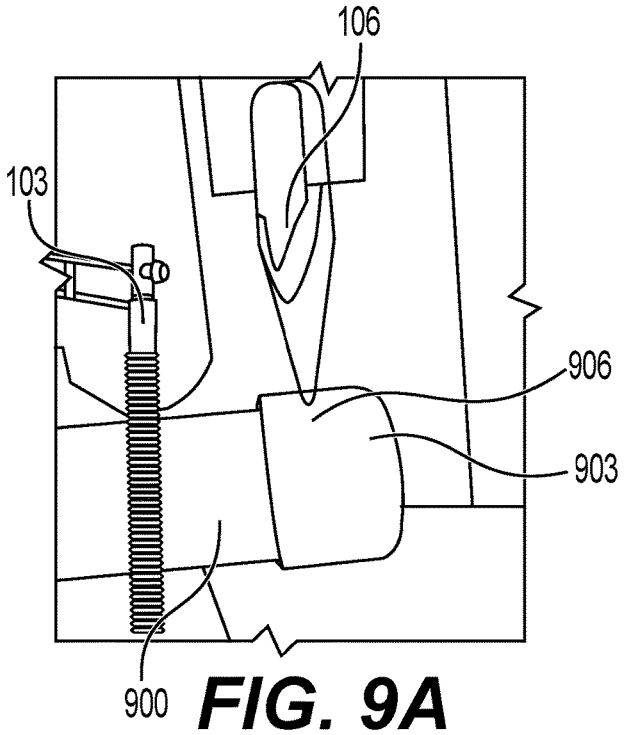
FIG. 9A illustrates a fourth exemplary IED positioned within the first hydraulic press prior to being rendered safe.

FIG. 9A illustrates a fourth exemplary IED 900 positioned within first hydraulic press 100 and secured via a clamp 103 prior to IED 900 being rendered safe. In this example, the IED 900 is a 2-inch diameter 12-inch long schedule 40 PVC pipe containing FFFg black powder. As illustrated, the IED 900 is positioned at step S504 such that the tip of the fracturing device 106 is vertically in line with the area 906 in the middle of the end cap 903 of the IED 900. The positioning of the IED 900 provides the most effective chances for fracture upon application of the fracturing device 106.

Figure 9B:
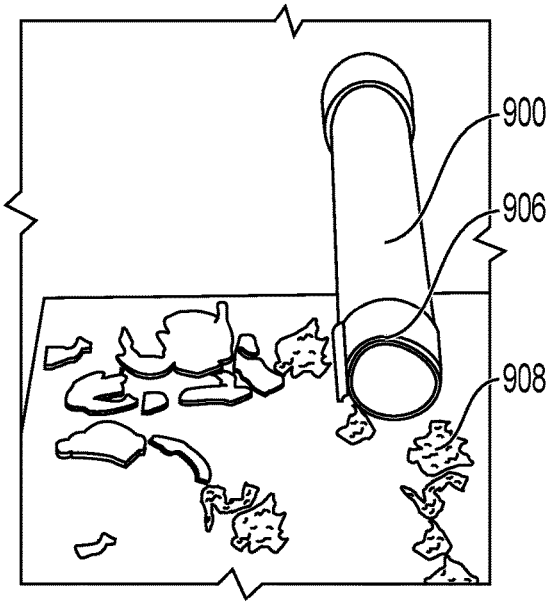
FIG. 9B illustrates the fourth exemplary IED after being rendered safe.

FIG. 9B illustrates the fourth IED 900 after being rendered safe by first hydraulic press 100. As shown in FIG. 9B, the IED 900 fractured precisely at the area 906 at which pressure was applied by the fracturing device 106 resulting in the safe expulsion of explosive filler 908

Figure 10A:
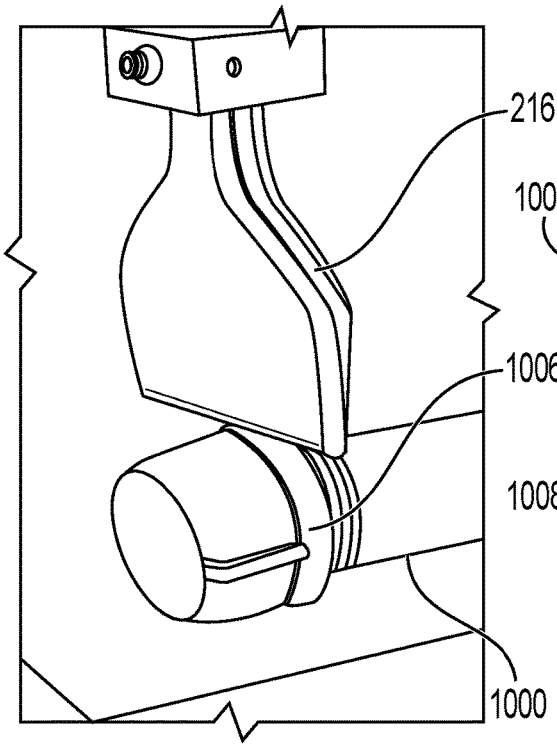
FIG. 10A illustrates a fifth exemplary IED positioned within the second hydraulic press prior to being rendered safe.

FIG. 10A illustrates a fifth exemplary IED 1000 positioned within second hydraulic press 200 prior to IED 1000 being rendered safe. In this example, the IED 1000 is a 1-inch diameter 6-inch long schedule 40 steel pipe nipple containing FFFg black powder. As illustrated, the IED 1000 is positioned at step S504 such that the tip of the fracturing device 216 vertically aligns with the area 1006 behind the flange of the internal plug side of the IED 1000. The positioning of the IED 1000 provides the most effective chances for fracture upon application of the fracturing device 106.

Figure 10B:
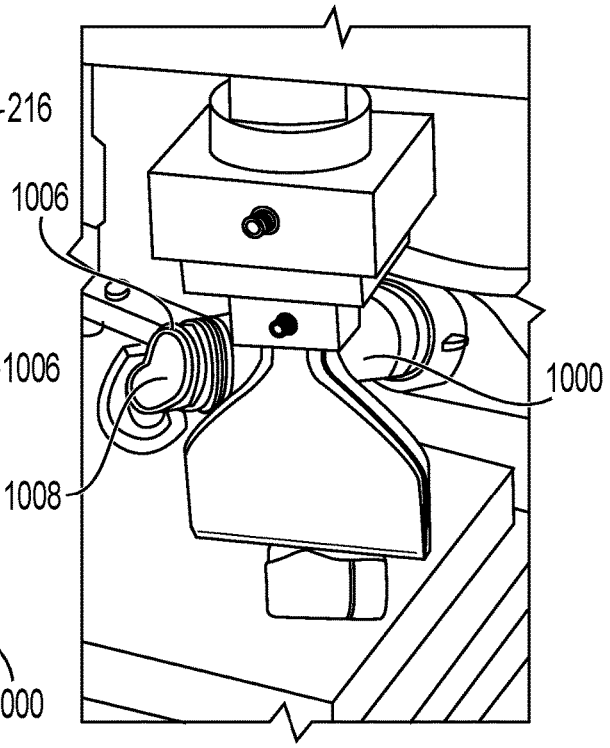
FIG. 10B illustrates the fifth exemplary IED after being rendered safe.

FIG. 10B illustrates the fifth IED 1000 after being rendered safe by second hydraulic press 200. As shown in FIG. 10B, the IED 1000 fractured precisely at the area 1006 at which pressure was applied by the fracturing device 216 resulting in the expulsion of explosive filler 1008.

Figure 11A:
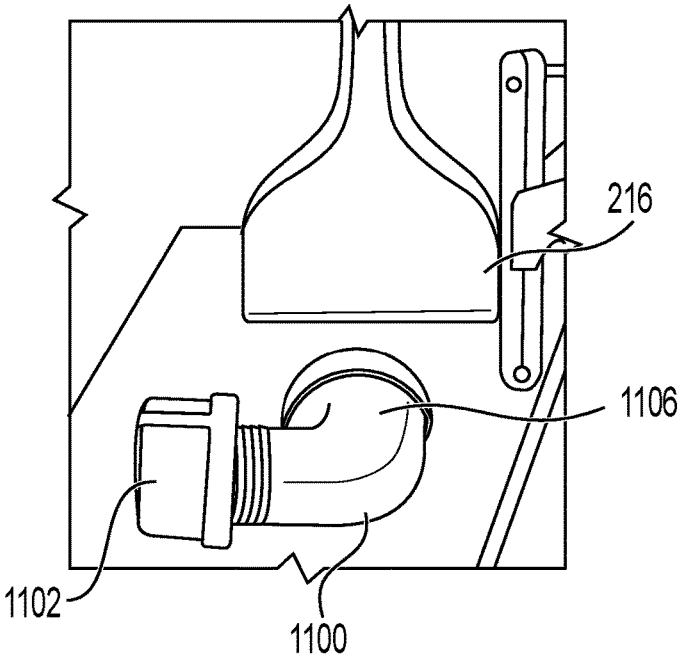
FIG. 11A illustrates a sixth exemplary IED positioned within the second hydraulic press prior to being rendered safe.

FIG. 11A illustrates a sixth exemplary IED 1100 positioned within second hydraulic press 200 prior to IED 1100 being rendered safe. In this example, the IED 1100 is a 1-inch diameter schedule 40 steel street elbow containing FFFg black powder and sealed with an external end cap 1102 and an internal plug (not shown). As illustrated, the IED 1100 is positioned at step S504 such that the tip of the fracturing device 216 is vertically in line with the area 1106 at the median of the turn of the elbow. The positioning of the IED 1100 provides the most effective chances for fracture upon application of the fracturing device 216.

Figure 11B:
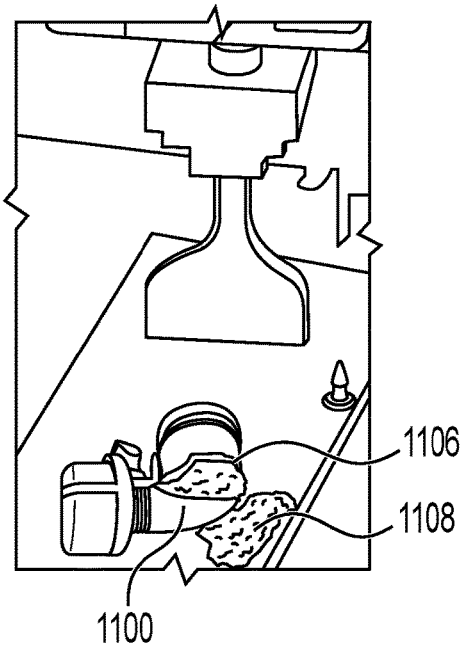
FIG. 11B illustrates the sixth exemplary IED after being rendered safe.

FIG. 11B illustrates the sixth IED 1100 after being rendered safe by second hydraulic press 200. As shown in FIG. 11B, the IED 1100 fractured precisely at the area 1106 at which pressure was applied by fracturing device 216, resulting in the safe expulsion of explosive filler 1108.

Figure 12A:
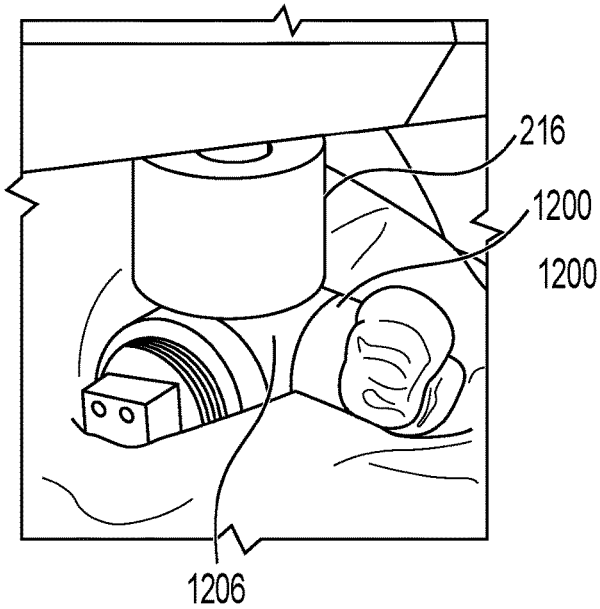
FIG. 12A illustrates a seventh exemplary IED positioned within the second hydraulic press prior to being rendered safe.

FIG. 12A illustrates a seventh exemplary IED 1200 positioned within the second hydraulic press 200 prior to IED 1200 being rendered safe. In this example, the IED 1200 is a 1-inch diameter schedule 40 steel street elbow containing flash powder. As illustrated, the IED 1200 is positioned at step S504 such the tip of the fracturing device 216 is vertically in line with the area 1206 at the median of the turn of the elbow. The positioning of the IED 1200 provides the most effective chances for fracture upon application of the fracturing device 216. Here, although dealing with highly reactive flash powder, the fracturing device 216 crushed the steel pipe elbow with an even distribution pattern which does not cause the flash powder to react.

Figure 12B:
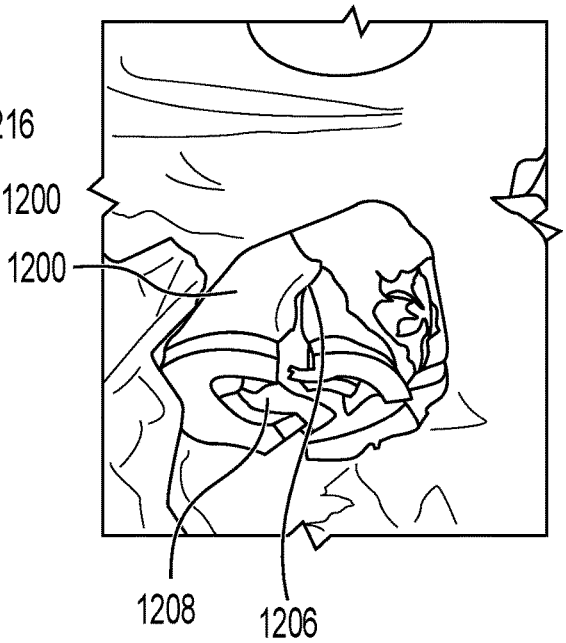
FIG. 12B illustrates the seventh exemplary IED after being rendered safe.

FIG. 12B illustrates the seventh exemplary IED 1200 after being rendered safe by second hydraulic press 200. As shown in FIG. 12B, the IED 1200 fractured precisely at the area 1206 at which pressure was applied by the fracturing device 216, resulting in the safe expulsion of explosive filler 1208.

The devices and methodologies described herein provide numerous advantages over existing implementations. The particular methodologies described herein, as shown, for example in FIG. 5, demonstrate that the slow time-controlled minimal interaction between the fracturing device and an IED minimizes compressive heating and the risk of detonation while safely fracturing a variety of IEDs. Thus, the lack of impact or shock, while still rendering an effective quasistatic force, results in a very low probability of detonation regardless of the explosive filler. Further, by implementing the methodologies described herein, the fracturing device does not fully penetrate the IED wall to cause fracture, and therefore does not directly compress the explosive filler. This reduces the risk of activating even highly explosive filler. This increases the chance operational success while also increasing the safety of the technicians and reducing potential explosive damage to nearby surroundings.

Those of skill in the art will understand that numerous modifications and variations of the present invention are possible in light of the above teachings. It is therefore also understood that within the scope of the appended claims, the invention may be practiced otherwise than as specifically described herein.

A number of implementations have been described. Nevertheless, it will be understood that various modifications may be made without departing from the spirit and scope of this disclosure. For example, preferable results may be achieved if the steps of the disclosed techniques are performed in a different sequence, if components in the disclosed systems are combined in a different manner, or if the components are replaced or supplemented by other components known to those of skill in the art.

The foregoing description, for purposes of explanation, used specific nomenclature to provide a thorough understanding of the present subject matter. However, it will be apparent to one skilled in the art that specific details are not required in order to practice the present subject matter. Thus, the foregoing descriptions of specific embodiments are presented for purposes of illustration and description. They are not intended to be exhaustive or to limit the invention to the precise forms disclosed, and many modifications and variations are possible in view of the above teachings. The embodiments were chosen and described in order to best explain the principles of the present subject matter and its practical applications.

The descriptions of the various embodiments of the present invention have been presented for purposes of illustration and are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, and to enable others of ordinary skill in the art to understand the embodiments disclosed herein. It will be understood that many additional changes in the details, materials, steps and arrangement of parts, which have been herein described and illustrated to explain the nature of the subject matter, may be made by those skilled in the art within the principle and scope of the present subject matter as expressed in the appended claims.

The invention claimed is:

1. A method for rendering safe an Improvised Explosive Device (IED) comprising:

identifying and classifying the IED;

selecting one of a plurality of platforms based on the type of IED and securing the selected platform to a powered mechanical press;

placing the IED into the powered mechanical press and positioning the IED within the press based on the classification of the IED;

selecting one of a plurality of fracturing devices based on the type of IED and securing the selected fracturing device to the powered mechanical press;

activating the press until the fracturing device of the press reaches a fracture position with respect to the IED;

holding the position of the press for a predetermined period of time when the fracturing device reaches the fracture position; and removing, after the IED has fractured, the fractured IED from the press and explosive filler from the fractured IED.

2. The method of claim 1, wherein, when the IED comprises a pipe fitting that is internally threaded on at least one end, positioning the IED within the press includes positioning the IED such that the fracturing device is in line with a position adjacent a flange of an internal plug side of the pipe fitting.

3. The method of claim 1, wherein, when the IED comprises a pipe nipple, positioning the IED within the press includes positioning the IED such that the fracturing device is in line with an end cap of the IED.

4. The method of claim 1, wherein, when the IED comprises a grenade body, positioning the IED within the press includes positioning the IED such that the fracturing device is positioned at or near the center of mass of the grenade body avoiding the fuze.

5. The method of claim 1, wherein, when the IED comprises a polyvinyl chloride (PVC) pipe, positioning the IED within the press includes positioning the IED such that the fracturing device is in line with an end cap of the PVC pipe.

6. The method of claim 1, further comprising: positioning the platform within the press at a position opposite the fracturing device.

7. The method of claim 6, further comprising:

securing the IED in the press via the platform, wherein positioning the IED within the press is further based on the type of platform.

8. The method of claim 1, further comprising:

securing, via a clamp, the IED within the press.

9. The method of claim 1, further comprising:

determining the type of fracturing device to secure to the press based on the classification of the IED.

10. The method of claim 1, further comprising:

determining the type of fracturing device to secure to the press based on at least one environmental condition.

11. The method of claim 1, further comprising:

inspecting the IED to determine a type of explosive filler within the IED; and determining the type of fracturing device to secure to the press based on the type of explosive filler within the IED.

12. The method of claim 1, further comprising:

determining the fracturing device of the press has reached the fracture position based on feedback from the press.

13. The method of claim 12, wherein the feedback is audio feedback.

14. The method of claim 12, wherein the feedback is vibrational feedback.

15. The method of claim 12, wherein the feedback is force feedback.

16. The method of claim 1, further comprising:

determining, after the predetermined period of time has elapsed, whether the IED has fractured; and reactivating, when the IED has not fractured, the press to apply additional pressure to the IED via the fracturing device and then deactivating the press to maintain the position of the press for the predetermined period of time.

17. The method of claim 16, further comprising:

reactivating, when the IED has not fractured, the press to apply additional pressure to the IED via the fracturing device and then deactivating the press to maintain the position of the press for the predetermined period of time one or more additional times until the IED fractures.

18. The method of claim 1, wherein the predetermined period of time is based on at least one environmental condition.

19. The method of claim 1, further comprising inspecting the IED to determine a type of explosive filler within the IED; and wherein the predetermined period of time is based on the type of explosive filler within the IED.

20. The method of claim 1, further comprising:

detecting an IED fracture.

21. The method of claim 1, wherein the press is controlled remotely from a distance.

22. The method of claim 1, wherein the IED comprises one of military ordnance, uncontrolled ordnance, an elbow pipe fitting, a pipe nipple, a civilian improvised grenade or a PVC pipe; and further wherein the military ordnance comprises one of a mortar shell, bomblet, submunition, rocket, or military grenade.

* * * * *